US010527042B2

(12) United States Patent
Stiles, Jr. et al.

(10) Patent No.: US 10,527,042 B2
(45) **Date of Patent: *Jan. 7, 2020**

(54) SPEED CONTROL

(71) Applicants: Pentair Water Pool and Spa, Inc., Sanford, NC (US); Danfoss Power Electronics A/S, Graasten (DK)

(72) Inventors: Robert W. Stiles, Jr., Cary, NC (US); Lars Hoffmann Berthelsen, Kolding (DK); Ronald B. Robol, Sanford, NC (US); Christopher Yahnker, Raleigh, NC (US); Daniel J. Hruby, Sanford, NC (US); Kevin Murphy, Quartz Hill, CA (US); Einar Kjartan Runarsson, Soenderborg (DK); Arne Fink Hansen, Graasten (DK); Florin Lungeanu, Beijing (CN); Peter Westermann-Rasmussen, Soenderborg (DK)

(73) Assignees: Pentair Water Pool and Spa, Inc., Cary, NC (US); Danfoss Power Electronics A/S, Graasten (DK)

( * ) Notice: Subject to any disclaimer, the term of this patent is extended or adjusted under 35 U.S.C. 154(b) by 410 days.

This patent is subject to a terminal disclaimer.

(21) Appl. No.: 14/680,947

(22) Filed: Apr. 7, 2015

(65) Prior Publication Data

US 2015/0211531 A1 Jul. 30, 2015

Related U.S. Application Data

(63) Continuation of application No. 13/906,177, filed on May 30, 2013, now Pat. No. 9,051,930, and a (Continued)

(51) Int. Cl.
*F04B 49/20* (2006.01)
*F04D 15/00* (2006.01)
(Continued)

(52) U.S. Cl.
CPC ..... *F04D 15/0066* (2013.01); *F04B 49/20* (2013.01); *F04D 13/06* (2013.01);
(Continued)

(58) Field of Classification Search
CPC ..... F04B 49/20; F04D 27/004; F04D 15/0066
See application file for complete search history.

(56) References Cited

U.S. PATENT DOCUMENTS 981,213 A 1/1911 Mollitor
1,993,267 A 3/1935 Ferguson
(Continued)

FOREIGN PATENT DOCUMENTS

AU 3940997 2/1998
AU 2005204246 A1 3/2006
(Continued)

OTHER PUBLICATIONS

9PX-42—Hayward Pool Systems; "Hayward EcoStar & EcoStar SVRS Variable Speed Pumps Brochure;" Civil Action 5:11-cv-00459D; 2010.

(Continued)

*Primary Examiner* — Bryan M Lettman
(74) *Attorney, Agent, or Firm* — Quarles & Brady LLP

(57) ABSTRACT

A pumping system for moving water of a swimming pool includes a water pump, an infinitely variable speed motor, and an arrangement for operating the motor. In one example, the pumping system includes a memory configured to store a plurality of retained speed values, an arrangement for providing a plurality of retained speed values to the memory, and an arrangement for reading a selected one of the plurality of retained speed values from the memory. In addition or alternatively, the pumping system includes a storage medium for digitally storing a plurality of pre-established motor speed values and an arrangement for
(Continued)

receiving input from a user to select one of the pre-established motor speeds. In addition or alternatively, the pumping system further includes an arrangement for restarting operation of the motor at a previously selected speed value when power supplied to the motor is interrupted during operation of the motor. A method for controlling the pumping system is also provided.

20 Claims, 7 Drawing Sheets

Related U.S. Application Data continuation of application No. 13/280,105, filed on Oct. 24, 2011, now Pat. No. 8,465,262, and a continuation of application No. 11/608,887, filed on Dec. 11, 2006, now Pat. No. 8,043,070, and a continuation-in-part of application No. 10/926,513, filed on Aug. 26, 2004, now Pat. No. 7,874,808, and a continuation-in-part of application No. 11/286,888, filed on Nov. 23, 2005, now Pat. No. 8,019,479.

(51) Int. Cl.

| | |
|---|---|
| ***F04D 27/00*** | (2006.01) |
| ***F04D 13/06*** | (2006.01) |
| *E04H 4/12* | (2006.01) |
| *F04B 49/06* | (2006.01) |

(52) U.S. Cl.

CPC ..... *F04D 27/004* (2013.01); *E04H 4/1245* (2013.01); *F04B 49/06* (2013.01); *Y10T 29/49817* (2015.01)

(56) References Cited

U.S. PATENT DOCUMENTS

| | | | |
|---|---|---|---|
| 2,238,597 | A | 4/1941 | Page |
| 2,458,006 | A | 1/1949 | Kilgore |
| 2,488,365 | A | 11/1949 | Abbott et al. |
| 2,494,200 | A | 1/1950 | Ramqvist |
| 2,615,937 | A | 10/1952 | Ludwig |
| 2,716,195 | A | 8/1955 | Anderson |
| 2,767,277 | A | 10/1956 | Wirth |
| 2,778,958 | A | 1/1957 | Hamm et al. |
| 2,881,337 | A | 4/1959 | Wall |
| 3,116,445 | A | 12/1963 | Wright |
| 3,191,935 | A | 6/1965 | Uecker |
| 3,204,423 | A | 10/1965 | Resh, Jr. |
| 3,213,304 | A | 10/1965 | Landerg et al. |
| 3,226,620 | A | 12/1965 | Elliott et al. |
| 3,227,808 | A | 1/1966 | Morris |
| 3,291,058 | A | 12/1966 | McFarlin |
| 3,316,843 | A | 5/1967 | Vaughan |
| 3,481,973 | A | 12/1969 | Wygant |
| 3,530,348 | A | 9/1970 | Connor |
| 3,558,910 | A | 1/1971 | Dale et al. |
| 3,559,731 | A | 2/1971 | Stafford |
| 3,562,614 | A | 2/1971 | Gramkow |
| 3,566,225 | A | 2/1971 | Paulson |
| 3,573,579 | A | 4/1971 | Lewus |
| 3,581,895 | A | 6/1971 | Howard et al. |
| 3,593,081 | A | 7/1971 | Forst |
| 3,594,623 | A | 7/1971 | LaMaster |
| 3,596,158 | A | 7/1971 | Watrous |
| 3,613,805 | A | 10/1971 | Lindstad |
| 3,624,470 | A | 11/1971 | Johnson |
| 3,634,842 | A | 1/1972 | Niedermeyer |
| 3,652,912 | A | 3/1972 | Bordonaro |
| 3,671,830 | A | 6/1972 | Kruger |
| 3,726,606 | A | 4/1973 | Peters |
| 1,061,919 | A | 5/1973 | Miller |
| 3,735,233 | A | 5/1973 | Ringle |
| 3,737,749 | A | 6/1973 | Schmit |
| 3,753,072 | A | 8/1973 | Jurgens |
| 3,761,750 | A | 9/1973 | Green |
| 3,761,792 | A | 9/1973 | Whitney |
| 3,777,232 | A | 12/1973 | Woods et al. |
| 3,777,804 | A | 12/1973 | McCoy |
| 3,778,804 | A | 12/1973 | Adair |
| 3,780,759 | A | 12/1973 | Yahle et al. |
| 3,781,925 | A | 1/1974 | Curtis |
| 3,787,882 | A | 1/1974 | Fillmore |
| 3,792,324 | A | 2/1974 | Suarez |
| 3,800,205 | A | 3/1974 | Zalar |
| 3,814,544 | A | 6/1974 | Roberts et al. |
| 3,838,597 | A | 10/1974 | Montgomery et al. |
| 3,867,071 | A | 2/1975 | Hartley |
| 3,882,364 | A | 5/1975 | Wright |
| 3,902,369 | A | 9/1975 | Metz |
| 3,910,725 | A | 10/1975 | Rule |
| 3,913,342 | A | 10/1975 | Barry |
| 3,916,274 | A | 10/1975 | Lewus |
| 3,941,507 | A | 3/1976 | Niedermeyer |
| 3,949,782 | A | 4/1976 | Athey et al. |
| 3,953,777 | A | 4/1976 | McKee |
| 3,956,760 | A | 5/1976 | Edwards |
| 3,963,375 | A | 6/1976 | Curtis |
| 3,972,647 | A | 8/1976 | Niedermeyer |
| 3,976,919 | A | 8/1976 | Vandevier |
| 3,987,240 | A | 10/1976 | Schultz |
| 4,000,446 | A | 12/1976 | Vandevier |
| 4,021,700 | A | 5/1977 | Ellis-Anwyl |
| 4,030,450 | A | 6/1977 | Hoult |
| 4,041,470 | A | 8/1977 | Slane et al. |
| 4,061,442 | A | 12/1977 | Clark et al. |
| 4,087,204 | A | 5/1978 | Niedermeyer |
| 4,108,574 | A | 8/1978 | Bartley et al. |
| 4,123,792 | A | 10/1978 | Gephart et al. |
| 4,133,058 | A | 1/1979 | Baker |
| 4,142,415 | A | 3/1979 | Jung et al. |
| 4,151,080 | A | 4/1979 | Zuckerman et al. |
| 4,157,728 | A | 6/1979 | Mitamura et al. |
| 4,168,413 | A | 9/1979 | Halpine |
| 4,169,377 | A | 10/1979 | Scheib |
| 4,182,363 | A | 1/1980 | Fuller et al. |
| 4,185,187 | A | 1/1980 | Rogers |
| 4,187,503 | A | 2/1980 | Walton |
| 4,206,634 | A | 6/1980 | Taylor |
| 4,215,975 | A | 8/1980 | Niedermeyer |
| 4,222,711 | A | 9/1980 | Mayer |
| 4,225,290 | A | 9/1980 | Allington |
| 4,228,427 | A | 10/1980 | Niedermeyer |
| 4,233,553 | A | 11/1980 | Prince |
| 4,241,299 | A | 12/1980 | Bertone |
| 4,255,747 | A | 3/1981 | Bunia |
| 4,263,535 | A | 4/1981 | Jones |
| 4,276,454 | A | 6/1981 | Zathan |
| 4,286,303 | A | 8/1981 | Genheimer et al. |
| 4,303,203 | A | 12/1981 | Avery |
| 4,307,327 | A | 12/1981 | Streater et al. |
| 4,309,157 | A | 1/1982 | Niedermeyer |
| 4,314,478 | A | 2/1982 | Beaman |
| 4,319,712 | A | 3/1982 | Bar |
| 4,322,297 | A | 3/1982 | Bajka |
| 4,330,412 | A | 5/1982 | Frederick |
| 4,332,527 | A | 6/1982 | Moldovan et al. |
| 4,353,220 | A | 10/1982 | Curwein |
| 4,366,426 | A | 12/1982 | Turlej |
| 4,369,438 | A | 1/1983 | Wilhelmi |
| 4,370,098 | A | 1/1983 | McClain et al. |
| 4,370,690 | A | 1/1983 | Baker |
| 4,371,315 | A | 2/1983 | Shikasho |
| 4,375,613 | A | 3/1983 | Fuller et al. |
| 4,384,825 | A | 5/1983 | Thomas et al. |
| 4,399,394 | A | 8/1983 | Ballman |
| 4,402,094 | A | 9/1983 | Sanders |
| 4,409,532 | A | 10/1983 | Hollenbeck |
| 4,419,625 | A | 12/1983 | Bejot et al. |
| 4,420,787 | A | 12/1983 | Tibbits et al. |
| 4,421,643 | A | 12/1983 | Frederick |
| 4,425,836 | A | 1/1984 | Pickrell |

(56) References Cited

U.S. PATENT DOCUMENTS 4,427,545 A 1/1984 Arguilez
4,428,434 A 1/1984 Gelaude
4,429,343 A 1/1984 Freud
4,437,133 A 3/1984 Rueckert
4,448,072 A 5/1984 Tward
4,449,260 A 5/1984 Whitaker
4,453,118 A 6/1984 Phillips
4,456,432 A 6/1984 Mannino
4,462,758 A 7/1984 Speed
4,463,304 A 7/1984 Miller
4,468,604 A 8/1984 Zaderej
4,470,092 A 9/1984 Lombardi
4,473,338 A 9/1984 Garmong
4,494,180 A 1/1985 Streater
4,496,895 A 1/1985 Kawate et al.
4,504,773 A 3/1985 Suzuki et al.
4,505,643 A 3/1985 Millis et al.
D278,529 S 4/1985 Hoogner
4,514,989 A 5/1985 Mount
4,520,303 A 5/1985 Ward
4,529,359 A 7/1985 Sloan
4,541,029 A 9/1985 Ohyama
4,545,906 A 10/1985 Frederick
4,552,512 A 11/1985 Gallup et al.
4,564,041 A 1/1986 Kramer
4,564,882 A 1/1986 Baxter
4,581,900 A 4/1986 Lowe
4,604,563 A 8/1986 Min
4,605,888 A 8/1986 Kim
4,610,605 A 9/1986 Hartley
4,620,835 A 11/1986 Bell
4,622,506 A 11/1986 Shemanske
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller, Jr.
4,670,697 A 6/1987 Wrege
4,676,914 A 6/1987 Mills et al.
4,678,404 A 7/1987 Lorett et al.
4,678,409 A 7/1987 Kurokawa
4,686,439 A * 8/1987 Cunningham ..... F04B 49/06 318/481
4,695,779 A 9/1987 Yates
4,697,464 A 10/1987 Martin
4,703,387 A 10/1987 Mller
4,705,629 A 11/1987 Weir
4,716,605 A 1/1988 Shepherd
4,719,399 A 1/1988 Wrege
4,728,882 A 3/1988 Stanbro
4,751,449 A 6/1988 Chmiel
4,751,450 A 6/1988 Lorenz
4,758,697 A 7/1988 Jeuneu
4,761,601 A 8/1988 Zaderej
4,764,417 A 8/1988 Gulya
4,764,714 A 8/1988 Alley
4,766,329 A 8/1988 Santiago
4,767,280 A 8/1988 Markuson
4,780,050 A 10/1988 Caine et al.
4,781,525 A 11/1988 Hubbard
4,782,278 A 11/1988 Bossi
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis
4,806,457 A 2/1989 Yanagisawa
4,820,964 A 4/1989 Kadah
4,827,197 A 5/1989 Giebler
4,834,624 A 5/1989 Jensen
4,837,656 A 6/1989 Barnes
4,839,571 A 6/1989 Farnham
4,841,404 A 6/1989 Marshall et al.
4,843,295 A 6/1989 Thompson
4,862,053 A 8/1989 Jordan
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi
4,958,118 A 9/1990 Pottebaum
4,963,778 A 10/1990 Jensen
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A 5/1991 Snyder, Jr. et al.
5,015,152 A 5/1991 Greene
5,017,853 A 5/1991 Chmiel
5,026,256 A 6/1991 Kuwabara
5,028,854 A 7/1991 Moline
5,041,771 A 8/1991 Min
5,051,068 A 9/1991 Wong
5,051,681 A 9/1991 Schwarz
5,076,761 A 12/1991 Krohn
5,076,763 A 12/1991 Anastos et al.
5,079,784 A 1/1992 Rist et al.
5,091,817 A 2/1992 Alley
5,098,023 A 3/1992 Burke
5,099,181 A 3/1992 Canon
5,100,298 A 3/1992 Shibata
RE33,874 E 4/1992 Miller
5,103,154 A 4/1992 Dropps
5,117,233 A 5/1992 Hamos et al.
5,123,080 A 6/1992 Gillett
5,129,264 A 7/1992 Lorenc
5,135,359 A 8/1992 Dufresne
5,145,323 A 9/1992 Farr
5,151,017 A * 9/1992 Sears ..... F04B 49/065 318/807
5,154,821 A 10/1992 Reid
5,156,535 A 10/1992 Budris
5,158,436 A 10/1992 Jensen
5,159,713 A 10/1992 Gaskell
5,164,651 A 11/1992 Hu
5,166,595 A 11/1992 Leverich
5,167,041 A 12/1992 Burkitt
5,172,089 A 12/1992 Wright et al.
D334,542 S 4/1993 Lowe
5,206,573 A 4/1993 McCleer et al.
5,213,477 A 5/1993 Watanabe et al.
5,222,867 A 6/1993 Walker, Sr. et al.
5,234,286 A 8/1993 Wagner
5,234,319 A 8/1993 Wilder
5,235,235 A 8/1993 Martin
5,238,369 A 8/1993 Far
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier
5,295,790 A 3/1994 Bossart et al.
5,295,857 A 3/1994 Toly
5,296,795 A 3/1994 Dropps
5,302,885 A 4/1994 Schwarz
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.

(56) References Cited

U.S. PATENT DOCUMENTS 5,360,320 A 11/1994 Jameson et al.
5,361,215 A * 11/1994 Tompkins ..... A61H 33/0095 236/12.12
5,363,912 A 11/1994 Wolcott
5,394,748 A 3/1995 McCarthy
5,418,984 A 5/1995 Livingston, Jr.
D359,458 S 6/1995 Pierret
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi
5,449,274 A 9/1995 Kochan, Jr.
5,449,997 A 9/1995 Gilmore et al.
5,450,316 A 9/1995 Gaudet et al.
D363,060 S 10/1995 Hunger
5,457,373 A 10/1995 Heppe et al.
5,457,826 A * 10/1995 Haraga ..... A61H 33/02 4/541.1
5,466,995 A 11/1995 Genga
5,469,215 A 11/1995 Nashiki
5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein
5,519,848 A 5/1996 Wloka
5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill
5,550,497 A 8/1996 Carobolante
5,550,753 A 8/1996 Tompkins et al.
5,559,418 A 9/1996 Burkhart
5,559,720 A 9/1996 Tompkins
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker
5,570,481 A 11/1996 Mathis et al.
5,571,000 A 11/1996 Zimmerman
5,577,890 A 11/1996 Nielson et al.
5,580,221 A 12/1996 Triezenberg
5,582,017 A 12/1996 Noji et al.
5,587,899 A 12/1996 Ho et al.
5,589,076 A 12/1996 Womack
5,589,753 A 12/1996 Kadah
5,592,062 A 1/1997 Bach
5,598,080 A 1/1997 Jensen
5,601,413 A 2/1997 Langley
5,604,491 A 2/1997 Coonley et al.
5,614,812 A 3/1997 Wagoner
5,616,239 A 4/1997 Wandell et al.
5,618,460 A 4/1997 Fowler
5,622,223 A 4/1997 Vasquez
5,624,237 A 4/1997 Prescott et al.
5,626,464 A 5/1997 Schoenmeyr
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,504 A 8/1997 Smith et al.
5,654,620 A 8/1997 Langhorst
5,669,323 A 9/1997 Pritchard
5,672,050 A 9/1997 Webber et al.
5,682,624 A 11/1997 Ciochetti
5,690,476 A 11/1997 Miller
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A 3/1998 Sterghos
5,731,673 A 3/1998 Gilmore
5,736,884 A 4/1998 Ettes et al.
5,739,648 A 4/1998 Ellis et al.
5,744,921 A 4/1998 Makaran
5,752,785 A 5/1998 Tanaka et al.
5,754,036 A 5/1998 Walker
5,754,421 A 5/1998 Nystrom
5,763,969 A 6/1998 Metheny et al.
5,767,606 A 6/1998 Bresolin
5,777,833 A 7/1998 Romillon
5,780,992 A 7/1998 Beard
5,791,882 A 8/1998 Stucker
5,796,234 A 8/1998 Vrionis
5,802,910 A 9/1998 Krahn et al.
5,804,080 A 9/1998 Klingenberger
5,808,441 A 9/1998 Nehring
5,814,966 A 9/1998 Williamson
5,818,708 A 10/1998 Wong
5,818,714 A 10/1998 Zou
5,819,848 A 10/1998 Ramusson
5,820,350 A 10/1998 Mantey et al.
5,828,200 A 10/1998 Ligman et al.
5,833,437 A 11/1998 Kurth et al.
5,836,271 A 11/1998 Saski
5,845,225 A 12/1998 Mosher
5,856,783 A 1/1999 Gibb
5,863,185 A 1/1999 Cochimin et al.
5,883,489 A 3/1999 Konrad
5,884,205 A * 3/1999 Elmore ..... A01B 79/005 222/63
5,892,349 A 4/1999 Bogwicz
5,894,609 A 4/1999 Barnett
5,898,958 A 5/1999 Hall
5,906,479 A 5/1999 Hawes
5,907,281 A 5/1999 Miller, Jr. et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad
5,946,469 A 8/1999 Chidester
5,947,689 A 9/1999 Schick
5,947,700 A 9/1999 McKain et al.
5,959,431 A 9/1999 Xiang
5,959,534 A 9/1999 Campbell
5,961,291 A 10/1999 Sakagami et al.
5,963,706 A 10/1999 Baik
5,969,958 A 10/1999 Nielsen
5,973,465 A 10/1999 Rayner
5,973,473 A 10/1999 Anderson
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasmussen
6,043,461 A 3/2000 Holling et al.
6,045,331 A 4/2000 Gehm et al.
6,045,333 A 4/2000 Breit
6,046,492 A 4/2000 Machida
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen

(56) References Cited

U.S. PATENT DOCUMENTS

| | | | |
|---|---|---|---|
| 6,080,973 | A | 6/2000 | Thweatt, Jr. |
| 6,081,751 | A | 6/2000 | Luo |
| 6,091,604 | A | 7/2000 | Plougsgaard |
| 6,092,992 | A | 7/2000 | Imblum |
| 6,094,026 | A | 7/2000 | Cameron |
| D429,699 | S | 8/2000 | Davis |
| D429,700 | S | 8/2000 | Liebig |
| 6,094,764 | A | 8/2000 | Veloskey et al. |
| 6,098,654 | A | 8/2000 | Cohen et al. |
| 6,102,665 | A | 8/2000 | Centers et al. |
| 6,110,322 | A | 8/2000 | Teoh et al. |
| 6,116,040 | A | 9/2000 | Stark |
| 6,121,746 | A | 9/2000 | Fishers |
| 6,121,749 | A | 9/2000 | Wills et al. |
| 6,125,481 | A | 10/2000 | Sicilano |
| 6,125,883 | A | 10/2000 | Creps et al. |
| 6,142,741 | A | 11/2000 | Nishihata |
| 6,146,108 | A | 11/2000 | Mullendore |
| 6,150,776 | A | 11/2000 | Potter et al. |
| 6,157,304 | A | 12/2000 | Bennett et al. |
| 6,164,132 | A | 12/2000 | Matulek |
| 6,171,073 | B1 | 1/2001 | McKain et al. |
| 6,178,393 | B1 | 1/2001 | Irvin |
| 6,184,650 | B1 | 2/2001 | Gelbman |
| 6,188,200 | B1 | 2/2001 | Maiorano |
| 6,198,257 | B1 | 3/2001 | Belehradek et al. |
| 6,199,224 | B1 | 3/2001 | Versland |
| 6,203,282 | B1 | 3/2001 | Morin |
| 6,208,112 | B1 | 3/2001 | Jensen et al. |
| 6,212,956 | B1 | 4/2001 | Donald |
| 6,213,724 | B1 | 4/2001 | Haugen |
| 6,216,814 | B1 | 4/2001 | Fujita et al. |
| 6,222,355 | B1 | 4/2001 | Ohshima |
| 6,227,808 | B1 | 5/2001 | McDonough |
| 6,232,742 | B1 | 5/2001 | Wachnov |
| 6,236,177 | B1 | 5/2001 | Zick |
| 6,238,188 | B1 | 5/2001 | McDonough |
| 6,247,429 | B1 | 6/2001 | Hara |
| 6,249,435 | B1 | 6/2001 | Lifson |
| 6,251,285 | B1 | 6/2001 | Clochetti |
| 6,253,227 | B1 | 6/2001 | Vicente et al. |
| D445,405 | S | 7/2001 | Schneider |
| 6,254,353 | B1 | 7/2001 | Polo |
| 6,257,304 | B1 | 7/2001 | Jacobs et al. |
| 6,257,833 | B1 | 7/2001 | Bates |
| 6,259,617 | B1 | 7/2001 | Wu |
| 6,264,431 | B1 | 7/2001 | Trizenberg |
| 6,264,432 | B1 | 7/2001 | Kilayko et al. |
| 6,280,611 | B1 | 8/2001 | Henkin et al. |
| 6,282,370 | B1 | 8/2001 | Cline et al. |
| 6,298,721 | B1 | 10/2001 | Schuppe et al. |
| 6,299,414 | B1 | 10/2001 | Schoenmeyr |
| 6,299,699 | B1 | 10/2001 | Porat et al. |
| 6,318,093 | B2 | 11/2001 | Gaudet et al. |
| 6,320,348 | B1 | 11/2001 | Kadah |
| 6,326,752 | B1 | 12/2001 | Jensen et al. |
| 6,329,784 | B1 | 12/2001 | Puppin |
| 6,330,525 | B1 | 12/2001 | Hays |
| 6,342,841 | B1 | 1/2002 | Stingl |
| 6,349,268 | B1 | 2/2002 | Ketonen et al. |
| 6,350,105 | B1 | 2/2002 | Kobayashi et al. |
| 6,351,359 | B1 | 2/2002 | Jager |
| 6,354,805 | B1 | 3/2002 | Moeller |
| 6,355,177 | B2 | 3/2002 | Senner et al. |
| 6,356,464 | B1 | 3/2002 | Balakrishnan |
| 6,356,853 | B1 | 3/2002 | Sullivan |
| 6,362,591 | B1 | 3/2002 | Moberg |
| 6,364,620 | B1 | 4/2002 | Fletcher et al. |
| 6,364,621 | B1 | 4/2002 | Yamauchi |
| 6,366,053 | B1 | 4/2002 | Belehradek |
| 6,366,481 | B1 | 4/2002 | Balakrishnan |
| 6,369,463 | B1 | 4/2002 | Maiorano |
| 6,373,204 | B1 | 4/2002 | Peterson |
| 6,373,728 | B1 | 4/2002 | Aarestrup |
| 6,374,854 | B1 | 4/2002 | Acosta |
| 6,375,430 | B1 | 4/2002 | Eckert et al. |
| 6,380,707 | B1 | 4/2002 | Rosholm |
| 6,388,642 | B1 | 5/2002 | Cotis |
| 6,390,781 | B1 | 5/2002 | McDonough |
| 6,406,265 | B1 | 6/2002 | Hahn |
| 6,407,469 | B1 | 6/2002 | Cline et al. |
| 6,411,481 | B1 | 6/2002 | Seubert |
| 6,415,808 | B2 | 7/2002 | Joshi |
| 6,416,295 | B1 | 7/2002 | Nagai |
| 6,426,633 | B1 | 7/2002 | Thybo |
| 6,443,715 | B1 | 9/2002 | Mayleben et al. |
| 6,445,565 | B1 | 9/2002 | Toyoda et al. |
| 6,447,446 | B1 | 9/2002 | Smith et al. |
| 6,448,713 | B1 | 9/2002 | Farkas et al. |
| 6,450,771 | B1 | 9/2002 | Centers |
| 6,462,971 | B1 | 10/2002 | Balakrishnan et al. |
| 6,464,464 | B2 | 10/2002 | Sabini |
| 6,468,042 | B2 | 10/2002 | Moller |
| 6,468,052 | B2 | 10/2002 | McKain et al. |
| 6,474,949 | B1 | 11/2002 | Arai |
| 6,475,180 | B2 | 11/2002 | Peterson et al. |
| 6,481,973 | B1 | 11/2002 | Struthers |
| 6,483,278 | B2 | 11/2002 | Harvest |
| 6,483,378 | B2 | 11/2002 | Blodgett |
| 6,490,920 | B1 | 12/2002 | Netzer |
| 6,493,227 | B2 | 12/2002 | Nielson et al. |
| 6,496,392 | B2 | 12/2002 | Odel |
| 6,499,961 | B1 | 12/2002 | Wyatt |
| 6,501,629 | B1 | 12/2002 | Mariott |
| 6,503,063 | B1 | 1/2003 | Brunsell |
| 6,504,338 | B1 | 1/2003 | Eichorn |
| 6,520,010 | B1 | 2/2003 | Bergveld |
| 6,522,034 | B1 | 2/2003 | Nakayama |
| 6,523,091 | B2 | 2/2003 | Tirumala |
| 6,527,518 | B2 | 3/2003 | Ostrowski |
| 6,534,940 | B2 | 3/2003 | Bell et al. |
| 6,534,947 | B2 | 3/2003 | Johnson |
| 6,537,032 | B1 | 3/2003 | Horiuchi |
| 6,538,908 | B2 | 3/2003 | Balakrishnan et al. |
| 6,539,797 | B2 | 4/2003 | Livingston |
| 6,543,940 | B2 | 4/2003 | Chu |
| 6,548,976 | B2 | 4/2003 | Jensen |
| 6,564,627 | B1 | 5/2003 | Sabini |
| 6,570,778 | B2 | 5/2003 | Lipo et al. |
| 6,571,807 | B2 | 6/2003 | Jones |
| 6,590,188 | B2 | 7/2003 | Cline |
| 6,591,697 | B2 | 7/2003 | Henyan |
| 6,591,863 | B2 | 7/2003 | Ruschell |
| 6,595,051 | B1 | 7/2003 | Chandler, Jr. |
| 6,595,762 | B2 | 7/2003 | Khanwilkar et al. |
| 6,604,909 | B2 | 8/2003 | Schoenmeyr |
| 6,607,360 | B2 | 8/2003 | Fong |
| 6,616,413 | B2 | 9/2003 | Humphries |
| 6,623,245 | B2 | 9/2003 | Meza et al. |
| 6,626,840 | B2 | 9/2003 | Drzewiecki |
| 6,628,501 | B2 | 9/2003 | Toyoda |
| 6,632,072 | B2 | 10/2003 | Lipscomb et al. |
| 6,636,135 | B1 | 10/2003 | Vetter |
| 6,638,023 | B2 | 10/2003 | Scott |
| D482,664 | S | 11/2003 | Hunt |
| 6,643,153 | B2 | 11/2003 | Balakrishnan |
| 6,651,900 | B1 | 11/2003 | Yoshida |
| 6,655,922 | B1 | 12/2003 | Flek |
| 6,663,349 | B1 | 12/2003 | Discenzo et al. |
| 6,665,200 | B2 | 12/2003 | Goto |
| 6,672,147 | B1 | 1/2004 | Mazet |
| 6,675,912 | B2 | 1/2004 | Carrier |
| 6,676,382 | B2 | 1/2004 | Leighton et al. |
| 6,676,831 | B2 | 1/2004 | Wolfe |
| 6,687,141 | B2 | 2/2004 | Odell |
| 6,687,923 | B2 | 2/2004 | Dick |
| 6,690,250 | B2 | 2/2004 | Moller |
| 6,696,676 | B1 | 2/2004 | Graves et al. |
| 6,700,333 | B1 | 3/2004 | Hirshi et al. |
| 6,709,240 | B1 | 3/2004 | Schmalz |
| 6,709,241 | B2 | 3/2004 | Sabini |
| 6,709,575 | B1 | 3/2004 | Verdegan |
| 6,715,996 | B2 | 4/2004 | Moeller |
| 6,717,318 | B1 | 4/2004 | Mathiasssen |

(56) References Cited

U.S. PATENT DOCUMENTS 6,732,387 B1 5/2004 Waldron
6,737,905 B1 5/2004 Noda
D490,726 S 6/2004 Eungprabhanth
6,742,387 B2 6/2004 Hamamoto
6,747,367 B2 6/2004 Cline et al.
6,758,655 B2 7/2004 Sacher
6,761,067 B1 7/2004 Capano
6,768,279 B1 7/2004 Skinner
6,770,043 B1 8/2004 Kahn
6,774,664 B2 8/2004 Godbersen
6,776,038 B1 8/2004 Horton et al.
6,776,584 B2 8/2004 Sabini et al.
6,778,868 B2 8/2004 Imamura et al.
6,779,205 B2 8/2004 Mulvey
6,779,950 B1 8/2004 Meier et al.
6,782,309 B2 * 8/2004 Laflamme ..... A61H 33/0087 392/465
6,783,328 B2 8/2004 Lucke
6,789,024 B1 9/2004 Kochan, Jr. et al.
6,794,921 B2 9/2004 Abe
6,797,164 B2 9/2004 Leaverton
6,798,271 B2 9/2004 Swize
6,806,677 B2 10/2004 Kelly et al.
6,837,688 B2 1/2005 Kimberlin et al.
6,842,117 B2 1/2005 Keown
6,847,130 B1 1/2005 Belehradek et al.
6,847,854 B2 1/2005 Discenzo
6,854,479 B2 2/2005 Harwood
6,863,502 B2 3/2005 Bishop et al.
6,867,383 B1 3/2005 Currier
6,875,961 B1 4/2005 Collins
6,882,165 B2 4/2005 Ogura
6,884,022 B2 4/2005 Albright
D504,900 S 5/2005 Wang
D505,429 S 5/2005 Wang
6,888,537 B2 5/2005 Albright
6,895,608 B2 5/2005 Goettl
6,900,736 B2 5/2005 Crumb
6,906,482 B2 6/2005 Shimizu
D507,243 S 7/2005 Miller
6,914,793 B2 7/2005 Balakrishnan
6,922,348 B2 7/2005 Nakajima
6,925,823 B2 8/2005 Lifson
6,933,693 B2 8/2005 Schuchmann
6,941,785 B2 9/2005 Haynes et al.
6,943,325 B2 9/2005 Pittman
6,973,794 B2 9/2005 Street
D511,530 S 11/2005 Wang
D512,026 S 11/2005 Nurmi
6,965,815 B1 11/2005 Tompkins et al.
6,966,967 B2 11/2005 Curry
D512,440 S 12/2005 Wang
6,973,974 B2 12/2005 McLoughlin et al.
6,976,052 B2 12/2005 Tompkins et al.
D513,737 S 1/2006 Riley
6,981,399 B1 1/2006 Nubp et al.
6,981,402 B2 1/2006 Bristol
6,984,158 B2 1/2006 Satoh
6,989,649 B2 1/2006 Melhorn
6,993,414 B2 1/2006 Shah
6,998,807 B2 2/2006 Phillips
6,998,977 B2 2/2006 Gregori et al.
7,005,818 B2 2/2006 Jensen
7,012,394 B2 3/2006 Moore et al.
7,015,599 B2 3/2006 Gull et al.
7,040,107 B2 5/2006 Lee et al.
7,042,192 B2 5/2006 Mehlhorn
7,050,278 B2 5/2006 Poulsen
7,055,189 B2 6/2006 Goettl
7,070,134 B1 7/2006 Hoyer
7,077,781 B2 7/2006 Ishikawa
7,080,508 B2 7/2006 Stavale
7,081,728 B2 7/2006 Kemp
7,083,392 B2 8/2006 Meza et al.
7,083,438 B2 * 8/2006 Massaro ..... G06F 1/181 439/133
7,089,607 B2 8/2006 Barnes et al.
7,100,632 B2 9/2006 Harwood
7,102,505 B2 9/2006 Kates
7,107,184 B2 9/2006 Gentile et al.
7,112,037 B2 9/2006 Sabini et al.
7,114,926 B2 10/2006 Oshita
7,117,120 B2 10/2006 Beck et al.
7,141,210 B2 11/2006 Bell
7,142,932 B2 11/2006 Spria et al.
D533,512 S 12/2006 Nakashima
7,163,380 B2 1/2007 Jones
7,172,366 B1 2/2007 Bishop, Jr.
7,174,273 B2 2/2007 Goldberg
7,178,179 B2 2/2007 Barnes
7,183,741 B2 2/2007 Mehlhorn
7,195,462 B2 3/2007 Nybo et al.
7,201,563 B2 4/2007 Studebaker
7,221,121 B2 5/2007 Skaug
7,244,106 B2 7/2007 Kallaman
7,245,105 B2 7/2007 Joo
7,259,533 B2 8/2007 Yang et al.
7,264,449 B1 9/2007 Harned et al.
7,281,958 B2 10/2007 Schuttler et al.
7,292,898 B2 11/2007 Clark et al.
7,307,538 B2 12/2007 Kochan, Jr.
7,309,216 B1 12/2007 Spadola et al.
7,318,344 B2 1/2008 Heger
D562,349 S 2/2008 Butler
7,327,275 B2 2/2008 Brochu
7,339,126 B1 3/2008 Niedermeyer
D567,189 S 4/2008 Stiles, Jr.
7,352,550 B2 4/2008 Mladenik
7,375,940 B1 5/2008 Bertrand
7,388,348 B2 6/2008 Mattichak
7,407,371 B2 8/2008 Leone
7,427,844 B2 9/2008 Mehlhorn
7,429,842 B2 9/2008 Schulman et al.
7,437,215 B2 10/2008 Anderson et al.
D582,797 S 12/2008 Fraser
D583,828 S 12/2008 Li
7,458,782 B1 12/2008 Spadola et al.
7,459,886 B1 12/2008 Potanin et al.
7,484,938 B2 2/2009 Allen
7,516,106 B2 4/2009 Ehlers
7,517,351 B2 4/2009 Culp et al.
7,525,280 B2 4/2009 Fagan et al.
7,528,579 B2 5/2009 Pacholok et al.
7,542,251 B2 6/2009 Ivankovic
7,542,252 B2 6/2009 Chan et al.
7,572,108 B2 8/2009 Koehl
7,612,510 B2 11/2009 Koehl
7,612,529 B2 11/2009 Kochan, Jr.
7,623,986 B2 11/2009 Miller
7,641,449 B2 1/2010 Iimura et al.
7,652,441 B2 1/2010 Ho
7,686,587 B2 3/2010 Koehl
7,686,589 B2 3/2010 Stiles et al.
7,690,897 B2 4/2010 Branecky
7,700,887 B2 4/2010 Niedermeyer
7,704,051 B2 4/2010 Koehl
7,707,125 B2 4/2010 Haji-Valizadeh
7,727,181 B2 6/2010 Rush
7,739,733 B2 6/2010 Szydlo
7,746,063 B2 6/2010 Sabini et al.
7,751,159 B2 7/2010 Koehl
7,755,318 B1 7/2010 Panosh
7,775,327 B2 8/2010 Abraham
7,777,435 B2 8/2010 Aguilar
7,788,877 B2 9/2010 Andras
7,795,824 B2 9/2010 Shen et al.
7,808,211 B2 10/2010 Pacholok et al.
7,815,420 B2 10/2010 Koehl
7,821,215 B2 10/2010 Koehl
7,845,913 B2 12/2010 Stiles et al.
7,854,597 B2 12/2010 Stiles et al.
7,857,600 B2 12/2010 Koehl
7,874,808 B2 1/2011 Stiles

(56) References Cited

U.S. PATENT DOCUMENTS 7,878,766 B2 2/2011 Meza
7,900,308 B2 3/2011 Erlich
7,925,385 B2 4/2011 Stavale et al.
7,931,447 B2 4/2011 Levin et al.
7,945,411 B2 5/2011 Kernan et al.
7,976,284 B2 7/2011 Koehl
7,983,877 B2 7/2011 Koehl
7,990,091 B2 8/2011 Koehl
8,007,255 B2 8/2011 Hattori et al.
8,011,895 B2 9/2011 Ruffo
8,019,479 B2 9/2011 Stiles
8,032,256 B1 10/2011 Wolf et al.
8,043,070 B2 * 10/2011 Stiles, Jr. ..... F04B 49/20 417/326
8,049,464 B2 11/2011 Muntermann
8,098,048 B2 1/2012 Hoff
8,104,110 B2 1/2012 Caudill et al.
8,126,574 B2 2/2012 Discenzo et al.
8,133,034 B2 3/2012 Mehlhorn et al.
8,134,336 B2 3/2012 Michalske et al.
8,164,470 B2 4/2012 Brochu et al.
8,177,520 B2 5/2012 Mehlhorn
8,281,425 B2 10/2012 Cohen
8,299,662 B2 10/2012 Schmidt et al.
8,303,260 B2 11/2012 Stavale et al.
8,313,306 B2 11/2012 Stiles et al.
8,316,152 B2 11/2012 Geltner et al.
8,317,485 B2 11/2012 Meza et al.
8,337,166 B2 12/2012 Meza et al.
8,380,355 B2 2/2013 Mayleben et al.
8,405,346 B2 3/2013 Trigiani
8,405,361 B2 3/2013 Richards et al.
8,444,394 B2 5/2013 Koehl
8,465,262 B2 * 6/2013 Stiles, Jr. ..... F04B 49/20 417/326
8,469,675 B2 6/2013 Stiles et al.
8,480,373 B2 7/2013 Stiles et al.
8,500,413 B2 8/2013 Stiles et al.
8,540,493 B2 9/2013 Koehl
8,547,065 B2 10/2013 Trigiani
8,573,952 B2 11/2013 Stiles et al.
8,579,600 B2 11/2013 Vijayakumar et al.
8,602,745 B2 12/2013 Stiles
8,641,383 B2 2/2014 Meza
8,641,385 B2 2/2014 Koehl
8,669,494 B2 3/2014 Tran
8,756,991 B2 6/2014 Edwards
8,763,315 B2 7/2014 Hartman
8,774,972 B2 7/2014 Rusnak
8,801,389 B2 8/2014 Stiles, Jr. et al.
8,981,684 B2 3/2015 Drye et al.
9,030,066 B2 5/2015 Drye
9,051,930 B2 * 6/2015 Stiles, Jr. ..... F04B 49/20
9,238,918 B2 1/2016 McKinzie
9,822,782 B2 11/2017 McKinzie
2001/0002238 A1 5/2001 McKain
2001/0029407 A1 10/2001 Tompkins
2001/0041139 A1 11/2001 Sabini et al.
2002/0000789 A1 1/2002 Haba
2002/0002989 A1 1/2002 Jones
2002/0010839 A1 1/2002 Tirumalal et al.
2002/0018721 A1 2/2002 Kobayashi
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0076330 A1 6/2002 Lipscomb et al.
2002/0082727 A1 6/2002 Laflamme et al.
2002/0089236 A1 7/2002 Cline et al.
2002/0093306 A1 7/2002 Johnson
2002/0101193 A1 8/2002 Farkas
2002/0111554 A1 8/2002 Drzewiecki
2002/0131866 A1 9/2002 Phillips
2002/0136642 A1 9/2002 Moller
2002/0143478 A1 10/2002 Vanderah et al.
2002/0150476 A1 10/2002 Lucke
2002/0163821 A1 11/2002 Odell
2002/0172055 A1 11/2002 Balakrishnan
2002/0176783 A1 11/2002 Moeller
2002/0190687 A1 12/2002 Bell et al.
2003/0000303 A1 1/2003 Livingston
2003/0017055 A1 1/2003 Fong
2003/0030954 A1 2/2003 Bax et al.
2003/0034284 A1 2/2003 Wolfe
2003/0034761 A1 2/2003 Goto
2003/0048646 A1 3/2003 Odell
2003/0049134 A1 3/2003 Leighton et al.
2003/0063900 A1 4/2003 Wang et al.
2003/0099548 A1 5/2003 Meza
2003/0106147 A1 6/2003 Cohen et al.
2003/0061004 A1 7/2003 Discenzo
2003/0138327 A1 * 7/2003 Jones ..... F04D 15/0066 417/42
2003/0174450 A1 9/2003 Nakajima et al.
2003/0186453 A1 10/2003 Bell
2003/0196942 A1 10/2003 Jones
2004/0000525 A1 1/2004 Hornsby
2004/0006486 A1 1/2004 Schmidt et al.
2004/0009075 A1 1/2004 Meza
2004/0013531 A1 1/2004 Curry et al.
2004/0016241 A1 1/2004 Street et al.
2004/0025244 A1 2/2004 Lloyd et al.
2004/0055363 A1 3/2004 Bristol
2004/0062658 A1 4/2004 Beck et al.
2004/0064292 A1 4/2004 Beck
2004/0071001 A1 4/2004 Balakrishnan
2004/0080325 A1 4/2004 Ogura
2004/0080352 A1 4/2004 Noda
2004/0090197 A1 5/2004 Schuchmann
2004/0095183 A1 5/2004 Swize
2004/0116241 A1 6/2004 Ishikawa
2004/0117330 A1 6/2004 Ehlers et al.
2004/0118203 A1 6/2004 Heger
2004/0149666 A1 8/2004 Ehlers et al.
2004/0205886 A1 10/2004 Goettel
2004/0213676 A1 10/2004 Phillips
2004/0261167 A1 * 12/2004 Panopoulos ..... E04H 4/169 4/490
2004/0265134 A1 12/2004 Iimura et al.
2005/0050908 A1 3/2005 Lee et al.
2005/0086957 A1 4/2005 Lifson
2005/0092946 A1 5/2005 Fellington et al.
2005/0095150 A1 5/2005 Leone et al.
2005/0097665 A1 5/2005 Goettel
2005/0123408 A1 * 6/2005 Koehl ..... F04D 15/0088 417/53
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0162787 A1 7/2005 Weigel
2005/0167345 A1 8/2005 De Wet et al.
2005/0168900 A1 8/2005 Brochu et al.
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik
2005/0226731 A1 10/2005 Mehlhorn
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 5/2006 Cohen
2006/0093492 A1 5/2006 Janesky
2006/0106503 A1 5/2006 Lamb et al.
2006/0127227 A1 6/2006 Mehlhorn
2006/0138033 A1 6/2006 Hoal et al.

(56) References Cited

U.S. PATENT DOCUMENTS

| | | | |
|---|---|---|---|
| 2006/0146462 | A1 | 7/2006 | McMillian et al. |
| 2006/0162787 | A1 | 7/2006 | Yeh |
| 2006/0169322 | A1 | 8/2006 | Torkelson |
| 2006/0201555 | A1 | 9/2006 | Hamza |
| 2006/0204367 | A1 | 9/2006 | Meza |
| 2006/0226997 | A1 | 10/2006 | Kochan, Jr. |
| 2006/0235573 | A1 | 10/2006 | Guion |
| 2006/0269426 | A1 | 11/2006 | Llewellyn |
| 2007/0001635 | A1 | 1/2007 | Ho |
| 2007/0041845 | A1 | 2/2007 | Freudenberger |
| 2007/0061051 | A1 | 3/2007 | Maddox |
| 2007/0080660 | A1 | 4/2007 | Fagan et al. |
| 2007/0113647 | A1 | 5/2007 | Mehlhorn |
| 2007/0114162 | A1 | 5/2007 | Stiles et al. |
| 2007/0124321 | A1 | 5/2007 | Szydlo |
| 2007/0154319 | A1 | 7/2007 | Stiles |
| 2007/0154320 | A1 | 7/2007 | Stiles |
| 2007/0154321 | A1 | 7/2007 | Stiles |
| 2007/0154322 | A1 | 7/2007 | Stiles |
| 2007/0154323 | A1 | 7/2007 | Stiles |
| 2007/0160480 | A1 | 7/2007 | Ruffo |
| 2007/0163929 | A1 | 7/2007 | Stiles |
| 2007/0183902 | A1 | 8/2007 | Stiles |
| 2007/0187185 | A1 | 8/2007 | Abraham et al. |
| 2007/0188129 | A1 | 8/2007 | Kochan, Jr. |
| 2007/0212210 | A1 | 9/2007 | Kernan et al. |
| 2007/0212229 | A1 | 9/2007 | Stavale et al. |
| 2007/0212230 | A1 | 9/2007 | Stavale et al. |
| 2007/0219652 | A1 | 9/2007 | McMillan |
| 2007/0258827 | A1 | 11/2007 | Gierke |
| 2008/0003114 | A1 | 1/2008 | Levin et al. |
| 2008/0031751 | A1 | 2/2008 | Littwin et al. |
| 2008/0031752 | A1 | 2/2008 | Littwin et al. |
| 2008/0039977 | A1 | 2/2008 | Clark et al. |
| 2008/0041839 | A1 | 2/2008 | Tran |
| 2008/0044293 | A1 | 2/2008 | Hanke et al. |
| 2008/0063535 | A1 | 3/2008 | Koehl |
| 2008/0095638 | A1 | 4/2008 | Branecky |
| 2008/0095639 | A1 | 4/2008 | Bartos |
| 2008/0131286 | A1 | 6/2008 | Ota |
| 2008/0131289 | A1 | 6/2008 | Koehl |
| 2008/0131291 | A1 | 6/2008 | Koehl |
| 2008/0131294 | A1 | 6/2008 | Koehl |
| 2008/0131295 | A1 | 6/2008 | Koehl |
| 2008/0131296 | A1 | 6/2008 | Koehl |
| 2008/0140353 | A1 | 6/2008 | Koehl |
| 2008/0152508 | A1 | 6/2008 | Meza |
| 2008/0168599 | A1 | 7/2008 | Caudill |
| 2008/0181785 | A1 | 7/2008 | Koehl |
| 2008/0181786 | A1 | 7/2008 | Meza |
| 2008/0181787 | A1 | 7/2008 | Koehl |
| 2008/0181788 | A1 | 7/2008 | Meza |
| 2008/0181789 | A1 | 7/2008 | Koehl |
| 2008/0181790 | A1 | 7/2008 | Meza |
| 2008/0189885 | A1 | 8/2008 | Erlich |
| 2008/0229819 | A1 | 9/2008 | Mayleben et al. |
| 2008/0260540 | A1 | 10/2008 | Koehl |
| 2008/0288115 | A1 | 11/2008 | Rusnak et al. |
| 2008/0298978 | A1 | 12/2008 | Schulman et al. |
| 2009/0014044 | A1 | 1/2009 | Hartman |
| 2009/0038696 | A1 | 2/2009 | Levin et al. |
| 2009/0052281 | A1 | 2/2009 | Nybo |
| 2009/0104044 | A1 | 4/2009 | Koehl |
| 2009/0143917 | A1 | 6/2009 | Uy et al. |
| 2009/0204237 | A1 | 8/2009 | Sustaeta et al. |
| 2009/0204267 | A1 | 8/2009 | Sustaeta et al. |
| 2009/0208345 | A1 | 8/2009 | Moore et al. |
| 2009/0210081 | A1 | 8/2009 | Sustaeta et al. |
| 2009/0269217 | A1 | 10/2009 | Vijayakumar |
| 2010/0079096 | A1 | 4/2010 | Braun et al. |
| 2010/0154534 | A1 | 6/2010 | Hampton |
| 2010/0166570 | A1 | 7/2010 | Hampton |
| 2010/0197364 | A1 | 8/2010 | Lee |
| 2010/0303654 | A1 | 12/2010 | Petersen et al. |
| 2010/0306001 | A1 | 12/2010 | Discenzo |
| 2010/0312398 | A1 | 12/2010 | Kidd et al. |
| 2011/0036164 | A1 | 2/2011 | Burdi |
| 2011/0044823 | A1 | 2/2011 | Stiles |
| 2011/0052416 | A1 | 3/2011 | Stiles |
| 2011/0061415 | A1 | 3/2011 | Ward |
| 2011/0066256 | A1 | 3/2011 | Sesay et al. |
| 2011/0077875 | A1 | 3/2011 | Tran |
| 2011/0084650 | A1 | 4/2011 | Kaiser et al. |
| 2011/0110794 | A1 | 5/2011 | Mayleben et al. |
| 2011/0280744 | A1 | 11/2011 | Ortiz et al. |
| 2011/0311370 | A1 | 12/2011 | Sloss et al. |
| 2012/0013285 | A1 | 1/2012 | Kasunich et al. |
| 2012/0020810 | A1 | 1/2012 | Stiles, Jr. et al. |
| 2012/0100010 | A1 | 4/2012 | Stiles et al. |
| 2013/0106217 | A1 | 5/2013 | Drye |
| 2013/0106321 | A1 | 5/2013 | Drye et al. |
| 2013/0106322 | A1 | 5/2013 | Drye |
| 2014/0018961 | A1 | 1/2014 | Guzelgunler |
| 2014/0372164 | A1 | 12/2014 | Egan et al. |

FOREIGN PATENT DOCUMENTS

| | | | |
|---|---|---|---|
| AU | 2007332716 | A1 | 6/2008 |
| AU | 2007332769 | A1 | 6/2008 |
| CA | 2548437 | A1 | 6/2005 |
| CA | 2731482 | A1 | 6/2005 |
| CA | 2517040 | A1 | 2/2006 |
| CA | 2528580 | A1 | 5/2007 |
| CA | 2672410 | A1 | 6/2008 |
| CA | 2672459 | A1 | 6/2008 |
| CN | 1821574 | A | 8/2006 |
| CN | 101165352 | | 4/2008 |
| DE | 3023463 | A1 | 2/1981 |
| DE | 3023463 | A1 | 2/1981 |
| DE | 2946049 | A1 | 5/1981 |
| DE | 29612980 | U1 | 10/1996 |
| DE | 19736079 | A1 | 8/1997 |
| DE | 19645129 | A1 | 5/1998 |
| DE | 29724347 | U1 | 11/2000 |
| DE | 10231773 | A1 | 2/2004 |
| DE | 19938490 | B4 | 4/2005 |
| EP | 0150068 | A2 | 7/1985 |
| EP | 0226858 | A1 | 7/1987 |
| EP | 0246769 | A2 | 11/1987 |
| EP | 0306814 | A1 | 3/1989 |
| EP | 0314249 | A1 | 3/1989 |
| EP | 0709575 | A1 | 5/1996 |
| EP | 0735273 | A1 | 10/1996 |
| EP | 0833436 | A2 | 4/1998 |
| EP | 0831188 | A3 | 2/1999 |
| EP | 0978657 | A1 | 2/2000 |
| EP | 1112680 | A2 | 4/2001 |
| EP | 1134421 | A1 | 9/2001 |
| EP | 0916026 | | 5/2002 |
| EP | 1315929 | | 6/2003 |
| EP | 1429034 | A2 | 6/2004 |
| EP | 1585205 | A2 | 10/2005 |
| EP | 1630422 | A2 | 3/2006 |
| EP | 1698815 | A1 | 9/2006 |
| EP | 1790858 | A1 | 5/2007 |
| EP | 1995462 | A2 | 11/2008 |
| EP | 2102503 | A2 | 9/2009 |
| EP | 2122171 | A1 | 11/2009 |
| EP | 2122172 | A1 | 11/2009 |
| EP | 2273125 | A1 | 1/2011 |
| FR | 2529965 | A1 | 1/1984 |
| FR | 2703409 | A1 | 10/1994 |
| GB | 2124304 | A1 | 2/1984 |
| JP | 55072678 | A | 5/1980 |
| JP | 5010270 | A | 1/1993 |
| MX | 2009006258 | A1 | 12/2009 |
| WO | 98/04835 | A1 | 2/1998 |
| WO | 00/42339 | A1 | 7/2000 |
| WO | 01/27508 | A1 | 4/2001 |
| WO | 01/47099 | A1 | 6/2001 |
| WO | 02/018826 | A1 | 3/2002 |
| WO | 03/025442 | A1 | 3/2003 |
| WO | 03/099705 | A2 | 12/2003 |
| WO | 2004/006416 | A1 | 1/2004 |

(56) References Cited

FOREIGN PATENT DOCUMENTS

| | | | |
|---|---|---|---|
| WO | 2004/073772 | A1 | 9/2004 |
| WO | 2004/088694 | A1 | 10/2004 |
| WO | 05/011473 | A1 | 2/2005 |
| WO | 2005011473 | A3 | 2/2005 |
| WO | 2005/055694 | A1 | 6/2005 |
| WO | 2005111473 | A2 | 11/2005 |
| WO | 2006/069568 | A1 | 7/2006 |
| WO | 2008/073329 | A1 | 6/2008 |
| WO | 2008/073330 | A1 | 6/2008 |
| WO | 2008073386 | A1 | 6/2008 |
| WO | 2008073413 | A1 | 6/2008 |
| WO | 2008073418 | A1 | 6/2008 |
| WO | 2008073433 | A1 | 6/2008 |
| WO | 2008073436 | A1 | 6/2008 |
| WO | 2011/100067 | A1 | 8/2011 |
| WO | 2014152926 | A1 | 9/2014 |
| ZA | 200506869 | | 5/2006 |
| ZA | 200509691 | | 11/2006 |
| ZA | 200904747 | | 7/2010 |
| ZA | 200904849 | | 7/2010 |
| ZA | 200904850 | | 7/2010 |

OTHER PUBLICATIONS 205-24-Exh23—Piaintiff's Preliminary Disclosure of Asserted Claims and Preliminary Infringement Contentions; cited in Civil Action 5:11-cv-00459; Feb. 21, 2012.
PX-34—Pentair; "IntelliTouch Pool & Spa Control System User's Guide"; pp. 1-129; 2011; cited in Civil Action 5:11-cv-00459; 2011.
PX-138—Deposition of Dr. Douglas C. Hopkins; pp. 1-391; 2011; taken in Civil Action 10-cv-1662.
PX-141—Danfoss; "Whitepaper Automatic Energy Optimization;" pp. 1-4; 2011; cited in Civil Action 5:11-cv-00459.
9PX10—Pentair; "IntelliPro VS+SVRS Intelligent Variable Speed Pump;" 2011; pp. 1-6; cited in Civil Action 5:11-cv-00459D.
9PX11—Pentair; "IntelliTouch Pool & Spa Control Control Systems;" 2011; pp. 1-5; cited in Civil Action 5:11-cv-004590.
Robert S. Carrow; "Electrician's Technical Reference-Variable Frequency Drives;" 2001; pp. 1-194.
Baldor; "Balder Motors and Drives Series 14 Vector Drive Control Operating & Technical Manual;" Mar. 22, 1992; pp. 1-92.
Commander; "Commander SE Advanced User Guide;" Nov. 2002; pp. 1-118.
Baldor; "Baldor Series 10 Inverter Control: Installation and Operating Manual"; Feb. 2000; pp. 1-74.
Dinverter; "Dinverter 28 User Guide;" Nov. 1998; pp. 1-94.
Pentair Pool Products, "IntelliFlo 4x160 a Breakthrough Energy-Efficiency and Service Life; " pp. 1-4; Nov. 2005; www.pentairpool.com.
Pentair Water and Spa, Inc. "The Pool Pro's guide to Breakthrough Efficiency, Convenience & Profitability," pp. 1-8, Mar. 2006; www.pentairpool.com.
Danfoss; "VLT8000 Aqua Instruction Manual;" Apr. 16, 2004; pp. 1-71.
"Product Focus—New AC Drive Series Target Water, Wastewater Applications;" WaterWorld Articles; Jul. 2002; pp. 1-2.
Pentair; "Pentair RS-485 Pool Controller Adapter" Published Advertisement; Mar. 22, 2002; pp. 1-2.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide," 2002; pp. 1-4.
Danfoss; "Danfoss VLT 6000 Series Adjustable Frequency Drive Installation, Operation and Maintenance Manual;" Mar. 2000; pp. 1-118.
Brochure entitled "Constant Pressure Water for Private Well Systems," for Myers Pentair Pump Group, Jun. 28, 2000.
Brochure for AMTROL, Inc. entitled "AMTROL unearths the facts about variable speed pumps and constant pressure valves," Mar. 2002.
Texas Instruments, Digital Signal Processing Solution for AC Induction Motor, Application Note, BPRA043 (1996).
Texas Instruments, Zhenyu Yu and David Figoli, DSP Digital Control System Applications—AC Induction Motor Control Using Constant V/Hz Principle and Space Vector PWM Technique with TMS320C240, Application Report No. SPRA284A (Apr. 1998).
Texas Instruments, TMS320F/C240 DSP Controllers Reference Guide Peripheral Library and Specific Devices, Literature No. SPRU 161D (Nov. 2002).
Texas Instruments, MSP430x33x—Mixed Signal Microcontrollers, SLAS 163 (Feb. 1998).
Microchip Technology, Inc., PICMicro Mid-Range MCU Family Reference Manual (Dec. 1997).
Load Controls Incorporated, product web pages including Affidavit of Christopher Butler of Internet Archive attesting to the authenticity of the web pages, dated Apr. 17, 2013, 19 pages.
Cliff Wyatt, "Monitoring Pumps," World Pumps, vol. 2004, Issue 459, Dec. 2004, pp. 17-21.
Wen Technology, Inc., Unipower® HPL110 Digital Power Monitor Installation and Operation, copyright 1999, pp. 1-20, Raleigh, North Carolina.
Wen Technology, Inc., Unipower® HPL110, HPL420 Programming Suggestions for Centrifugal Pumps, copyright 1999, 4 pages, Raleigh, North Carolina.
Danfoss, VLT® Aqua Drive, "The ultimate solution for Water, Wastewater, & Irrigation", May 2007, pp. 1-16.
Danfoss, Salt Drive Systems, "Increase oil & gas production, Minimize energy consumption", copyright 2011, pp. 1-16.
Schlumberger Limited, Oilfield Glossary, website Search Results for "pump-off", copyright 2014, 1 page.
Pent Air; "Pentair IntelliTouch Operating Manual;" May 22, 2003; pp. 1-60.
51—Response by Defendants in Opposition to Motion for Preliminary Injunction for Civil Action 5:11-cv-00459D; Dec. 2, 2011.
53—Declaration of Douglas C. Hopkins & Exhibits re Response Opposing Motion for Preliminary Injunction for Civil Action 5:11-cv-00459D; Dec. 2, 2011.
89—Reply to Response to Motion for Preliminary Injunction Filed by Danfoss Drives A/S & Pentair Water Pool & Spa, Inc. for Civil Action 5:11-cv-004590; Jan. 3, 2012.
105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—0rder Denying Motion for Preliminary Injunction for Civil Action 5:11-cv-00459D; Jan. 23, 2012.
123—Answer to Amended Complaint, Counterclaim Against Danfoss Drives A/S, Pentair Water Pool & Spa, Inc. for Civil Action 5:11-cv-00459D; Jan. 27, 2012.
152—Order Denying Motion for Reconsideration for Civil Action 5:11-cv-00459D; Apr. 4, 2012.
168—Amended Motion to Stay Action Pending Reexamination of Asserted Patents by Defendants for Civil Action 5:11-cv-004590; Jun. 13, 2012.
174—Notice and Attachments re Joint Claim Construction Statement for Civil Action 5:11-cv-00459D; Jun. 5, 2012.
186—0rder Setting Hearings—Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for Civil Action 5:11-cv-004590; Jul. 2012.
210—0rder Granting Joint Motion for Leave to Enlarge Page Limit for Civil Action 5:11-cv-004590; Jul. 2012.
218—Notice re Plaintiffs re Order on Motion for Leave to File Excess Pages re Amended Joint Claim Construction Statement for Civil Action 5:11-cv-004590; Aug. 2012.
54DX17—Hayward ProLogic Automation & Chlorination Operation Manual (Rev. F); pp. 1-27; Elizabeth, NJ; cited in Civil Action 5:11-cv-004590; Dec. 2, 2011.
54DX18—Stmicroelectronics; "AN1946—Sensorless BLOC Motor Control & BEMF Sampling Methods with ST7MC;" 2007; pp. 1-35; Civil Action 5:11-cv-004590.

(56) References Cited

OTHER PUBLICATIONS

54DX21—Danfoss; "VLT 8000 Aqua Instruction Manual;" Apr. 2004; 1-210; Cited in Civil Action 5:11-cv-004590.
54DX22—Danfoss; "VLT 8000 Aqua Instruction Manual;" pp. 1-35; cited in Civil Action 5:11-cv-004590; Dec. 2, 2011.
54DX23—Commander; "Commander SE Advanced User Guide;" Nov. 2002; pp. 1-190; cited in Civil Action 5:11-cv-004590.
540X30—Sabbagh et al.; "A Model for OptimaL.Control of Pumping Stations in Irrigation Systems;" Jul. 1988; NL pp. 119-133; Civil Action 5:11-cv-004590.
540X31—0anfoss; "VLT 5000 FLUX Aqua OeviceNet Instruction Manual;" Apr. 28, 2003; pp. 1-39; cited in Civil Action 5:11-cv-004590.
540X32—0anfoss; "VLT 5000 FLUX Aqua Profibus Operating Instructions;" May 22, 2003; 1-64; cited in Civil Action 5:11-cv-004590.
540X33—Pentair; "IntelliTouch Owner's Manual Set-Up & Programming;" May 22, 2003; Sanford, NC; pp. 1-61; cited in Civil Action 5:11-cv-004590.
540X34—Pentair; "Compool3800 Pool-Spa Control System Installation & Operating Instructions;" Nov. 7, 1997; pp. 1-45; cited in Civil Action 5:11-cv-004590.
540X35—Pentair Advertisement in "Pool & Spa News;" Mar. 22, 2002; pp. 1-3; cited in Civil Action 5:11-cv-004590.
5540X36—Hayward; "Pro-Series High-Rate Sand Filter Owner's Guide;" 2002; Elizabeth, NJ; pp. 1-5; cited in Civil Action 5:11-cv-00459D.
540X37—Danfoss; "VLT 8000 Aqua Fact Sheet;" Jan. 2002; pp. 1-3; cited in Civil Action 5:11-cv-004590.
540X38—0anfoss; "VLT 6000 Series Installation, Operation & Maintenance Manual;" Mar. 2000; pp. 1-118; cited in Civil Action 5:11-cv-004590.
540X45—Hopkins; "Synthesis of New Class of Converters that Utilize Energy Recirculation;" pp. 1-7; cited in Civil Action 5:11-cv-004590; 1994.
540X46—Hopkins; "High-Temperature, High-Oensity . . . Embedded Operation;" pp. 1-8; cited in Civil Action 5:11-cv-004590; Mar. 2006.
540X47—Hopkins; "Optimally Selecting Packaging Technologies . . . Cost & Performance;" pp. 1-9; cited in Civil Action 5:11-cv-004590; Jun. 1999.
9PX5—Pentair; Selected Website Pages; pp. 1-29; cited in Civil Action 5:11-cv-004590; Sep. 2011.
9PX6—Pentair; "IntelliFio Variable Speed Pump" Brochure; 2011; pp. 1-9; cited in Civil Action 5:11-cv-004590.
9PX7—Pentair; "IntelliFio VF Intelligent Variable Flow Pump;" 2011; pp. 1-9; cited in Civil Action 5:11-cv-004590.
9PX8—Pentair; "IntelliFio VS+SVRS Intelligent Variable Speed Pump;" 2011; pp. 1-9; cited in Civil Action 5:11-cv-004590.
9PX9—Sta-Rite; "IntelliPro Variable Speed Pump;" 2011; pp. 1-9; cited in Civil Action 5:11-cv-004590.
9PX14—Pentair; "IntelliFio Installation and User's Guide;" pp. 1-53; Jul. 26, 2011; Sanford, NC; cited in Civil Action 5:11-cv-004590.
9PX16—Hayward Pool Products; "EcoStar Owner's Manual (Rev. B);" pp. 1-32; Elizabeth, NJ; cited in Civil Action 5:11-cv-00459D; 2010.
9PX17—Hayward Pool Products; "EcoStar & EcoStar SVRS Brochure;" pp. 1-7; Elizabeth, NJ; cited in Civil Action 5:11-cv-00459D; Sep. 30, 2011.
9PX19—Hayward Pool Products;"Hayward Energy Solutions Brochure;" pp. 1-3; www.haywardnet.com; cited in Civil Action 5:11-cv-00459D; Sep. 2011.
9PX20—Hayward Pool Products; "ProLogic Installation Manual (Rev. G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX22—Hayward Pool Products; "Wireless & Wired Remote Controls Brochure;" pp. 1-5; 2010; Elizabeth, NJ; cited in Civil Action 5:11-cv-00459D.
9PX23—Hayward Pool Products; Selected Pages from Hayward's Website:/www.hayward-pool.com; pp. 1-27; cited in Civil Action 5:11-cv-004590; Sep. 2011.
9PX28—Hayward Pool Products; "Selected Page from Hayward's Website Relating to EcoStar Pumps;" p. 1; cited in Civil Action 5:11-cv-00459D; Sep. 2011.
9PX29—Hayward Pool Products; "Selected Page from Hayward's Website Relating to EcoStar SVRS Pumps;" cited in Civil Action 5:11-cv-00459; Sep. 2011.
9PX30—Hayward Pool Systems; "Selected Pages from Hayward's Website Relating to ProLogic Controllers;" pp. 1-5; Civil Action 5:11-cv-00459D; Sep. 2011.
Flotec Owner's Manual, dated 2004. 44 pages.
Glentronics Home Page, dated 2007. 2 pages.
Goulds Pumps SPBB Battery Back-Up Pump Brochure, dated 2008. 2 pages.
Goulds Pumps SPBB/SPBB2 Battery Backup Sump Pumps, dated 2007.
ITT Red Jacket Water Products Installation, Operation and Parts Manual, dated 2009. 8 pages.
Liberty Pumps PC-Series Brochure, dated 2010. 2 pages.
"Lift Station Level Control" by Joe Evans PhD, www.pumped101.com, dated Sep. 2007. 5 pages.
The Basement Watchdog A/C—D/C Battery Backup Sump Pump System Instruction Manual and Safety Warnings, dated 2010. 20 pages.
The Basement Watchdog Computer Controlled A/C—D/C Sump Pump System Instruction Manual, dated 2010. 17 pages.
Pentair Water Ace Pump Catalog, dated 2007, 44 pages.
ITT Red Jacket Water Products RJBB/RJBB2 Battery Backup Sump Pumps; May 2007, 2 pages.
Allen-Bradley; "1336 PLUS II Adjustable Frequency AC Drive with Sensorless Vector User Manual;" Sep. 2005; pp. 1-212.
Decision on Appeal issued in Appeal No. 2015-007909, regarding *Hayward Industries, Inc.* v. *Pentair Ltd.*, dated Apr. 1, 2016, 19 pages.
U.S. Appl. No. 12/869,570 Appeal Decision dated May 24, 2016.
USPTO Patent Board Decision—Examiner Reversed; Appeal No. 2015-007909 re: U.S. Pat. No. 7,686,587B2; dated Apr. 1, 2016.
USPTO Patent Board Decision—Examiner Affirmed in Part; Appeal No. 2016-002780 re: U.S. Pat. No. 7,854,597B2; dated Aug. 30, 2016.
USPTO Patent Board Decision—Decision on Reconsideration, Denied; Appeal No. 2015-007909 re: U.S. Pat. No. 7,686,587B2; dated Aug. 30, 2016.
USPTO Patent Trial and Appeal Board, Paper 43—Final Written Decision, Case IPR2013-00287, U.S. Pat. No. 7,704,051 B2, Nov. 19, 2014, 28 pages.
Per Brath—Danfoss Drives A/S, Towards Autonomous Control of HVAC Systems, thesis with translation of Introduction, Sep. 1999, 216 pages.
Karl Johan Aström and Björn Wittenmark—Lund Institute of Technology, Adaptive Control—Second Edition, book, Copyright 1995, 589 pages, Addison-Wesley Publishing Company, United States and Canada.
Bimal K. Bose—The University of Tennessee, Knoxville, Modern Power Electronics and AC Drives, book, Copyright 2002, 728 pages, Prentice-Hall, Inc., Upper Saddle River, New Jersey.
Waterworld, New AC Drive Series Targets Water, Wastewater Applications, magazine, Jul. 2002, 5 pages, vol. 18, Issue 7.
Texas Instruments, TMS320F/C240 DSP Controllers Peripheral Library and Specific Devices, Reference Guide, Nov. 2002, 485 pages, printed in U.S.A.
Microchip Technology Inc., PICmicro® Advanced Analog Microcontrollers for 12-Bit ADC on 8-Bit MCUs, Convert to Microchip, brochure, Dec. 2000, 6 pages, Chandler, Arizona.
W.K. Ho, S.K. Panda, K.W. Lim, F.S. Huang—Department of Electrical Engineering, National University of Singapore, Gain-

(56) References Cited

OTHER PUBLICATIONS scheduling control of the Switched Reluctance Motor, Control Engineering Practice 6, copyright 1998, pp. 181-189, Elsevier Science Ltd.
Jan Eric Thorsen—Danfoss, Technical Paper—Dynamic simulation of DH House Stations, presented by 7. Dresdner Femwärme-Kolloquium Sep. 2002, 10 pages, published in Euro Heat & Power Jun. 2003.
Texas Instruments, Electronic Copy of TMS320F/C240 DSP Controllers Reference Guide, Peripheral Library and Specific Devices, Jun. 1999, 474 pages.
Rajwardhan Patil, et al., A Multi-Disciplinary Mechatronics Course with Assessment—Integrating Theory and Application through Laboratory Activities, International Journal of Engineering Education, copyright 2012, pp. 1141-1149, vol. 28, No. 5, Tempus Publications, Great Britain.
Shabnam Moghanrabi; "Better, Stronger, Faster;" Pool & Spa News, Sep. 3, 2004; pp. 1-5; www/poolspanews.com.
Grundfos Pumps Corporation; "The New Standard in Submersible Pumps;" Brochure; pp. 1-8; Jun. 1999; Fresno, CA USA.
Grundfos Pumps Corporation; "Grundfos SQ/SQE Data Book;" pp. 1-39; Jun. 1999; Fresno, CA USA.
Goulds Pumps; "Balanced Flow System Brochure;" pp. 1-4; 2001.
Goulds Pumps; "Balanced Flow Submersible System Installation, Operation & Trouble-Shooting Manual;" pp. 1-9; 2000; USA.
Goulds Pumps; "Balanced Flow System Variable Speed Submersible Pump" Specification Sheet; pp. 1-2; Jan. 2000; USA.
Goulds Pumps; Advertisement from "Pumps & Systems Magazine;" entitled "Cost Effective Pump Protection+ Energy Savings," Jan. 2002; Seneca Falls, NY.
Goulds Pumps; "Hydro-Pro Water System Tank Installation, Operation & Maintenance Instructions;" pp. 1-30; Mar. 31, 2001; Seneca Falls, NY USA.
Goulds Pumps; "Pumpsmart Control Solutions" Advertisement from Industrial Equipment News; Aug. 2002; New York, NY USA.
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan. 2001; USA.
Goulds Pumps; "Balanced Flow System Model BFSS Variable Speed Submersible Pump" Brochure; pp. 1-3; Jan. 2000; USA.
AMTROL Inc.; "AMTROL Unearths the Facts About Variable Speed Pumps and Constant Pressure Valves;" pp. 1-5; Mar. 2002; West Warwick, RI USA.
Franklin Electric; "CP Water-Subdrive 75 Constant Pressure Controller" Product Data Sheet; May 2001; Bluffton, IN USA.
Franklin Electric; "Franklin Aid, Subdrive 75: You Made It Better;" vol. 20, No. 1; pp. 1-2; Jan./Feb. 2002; www.franklin-electric.com.
Email Regarding Grundfos' Price Increases/SQ/SQE Curves; pp. 1-7; Dec. 19, 2001.
F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000.
"Understanding Constant Pressure Control;" pp. 1-3; Nov. 1, 1999.
"Constant Pressure is the Name of the Game;" Published Article from National Driller; Mar. 2001.
Sje-Rhombus; "Variable Frequency Drives for Constant Pressure Control;" Aug. 2008; pp. 1-4; Detroit Lakes, MN USA.
Sje-Rhombus; "Constant Pressure Controller for Submersible Well Pumps;" Jan. 2009; pp. 1-4; Detroit Lakes, MN USA.
Sje-Rhombus; "SubCon Variable Frequency Drive;" Dec. 2008; pp. 1-2; Detroit Lakes, MN USA.
Grundfos; "SmartFio SQE Constant Pressure System;" Mar. 2002; pp. 1-4; Olathe, KS USA.
Grundfos; "Grundfos SmartFio SQE Constant Pressure System;" Mar. 2003; pp. 1-2; USA.
Grundfos; "CU301 Installation & Operation Manual;" Apr. 2009; pp. 1-2; Undated; www.grundfos.com.
Grundfos; "CU301 Installation & Operating Instructions;" Sep. 2005; pp. 1-30; Olathe, KS USA.
ITT Corporation; "Goulds Pumps Balanced Flow Submersible Pump Controller;" Jul. 2007; pp. 1-12.
ITT Corporation; "Goulds Pumps Balanced Flow;" Jul. 2006; pp. 1-8.
ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
Franklin Electric; "Franklin Application Installation Data;" vol. 21, No. 5, Sep./Oct. 2003; pp. 1-2; www.franklin-electric.com.
Franklin Electric; "Monodrive MonodriveXT Single-Phase Constant Pressure;" Sep. 2008; pp. 1-2; Bluffton, IN USA.
Docket Report for Case No. 5:11-cv-00459-D; Nov. 2012.
1—Complaint Filed by Pentair Water Pool & Spa, Inc. and Danfoss Drives A/S with respect to Civil Action No. 5:11-cv-00459-D; Aug. 31, 2011.
7—Motion for Preliminary Injunction by Danfoss Drives AIS & Pentair Water Pool & Spa, Inc. with respect to Civil Action No. 5:11-cv-00459-D; Sep. 30, 2011.
22—Memorandum in Support of Motion for Preliminary Injunction by Plaintiffs with respect to Civil Action 5:11-cv-00459-D; Sep. 2, 2011.
23—Declaration of E. Randolph Collins, Jr. in Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32—Answer to Complaint with Jury Demand & Counterclaim Against Plaintiffs by Hayward Pool Products & Hayward Industries for Civil Action 5:11-cv-004590; Oct. 12, 2011.
USPTO Patent Trial and Appeal Board, Paper 47—Final Written Decision, Case IPR2013-00285, U.S. Pat. No. 8,019,479 B2, dated Nov. 19, 2014, 39 pages.
Pentair Pool Products, WhisperFlo Pump Owner's Manual, Jun. 5, 2001, 10 pages.
U.S. Court of Appeals for the Federal Circuit, Notice of Entry of Judgment, accompanied by Opinion, in Case No. 2017-1021, Document 57-1, filed and entered Feb. 7, 2018, pp. 1-16.
U.S. Court of Appeals for the Federal Circuit, Notice of Entry of Judgment, accompanied by Opinion, in Case No. 2017-1124, Document 54-1, filed and entered Feb. 26, 2018, pp. 1-10.
U.S. Patent Trial and Appeal Board's Rule 36 Judgment, without opinion, in Case No. 2016-2598, dated Aug. 15, 2017, pp. 1-2.
Bibliographic Data Sheet—U.S. Appl. No. 10/730,747 Applicant: Robert M. Koehl Reasons for Inclusion: Printed publication US 2005/0123408 A1 for U.S. Application No. 10/730,747, dated Sep. 7, 2007.
Goulds Pumps; "Balanced Flow Submersible System Informational Seminar;" pp. 1-22; dated at least as early as Dec. 30, 2014.
Goulds Pumps; "Balanced Flow System . . . The Future of Constant Pressure Has Arrived;" Advertisement, dated at least as early as Jul. 3, 2013.
Grundfos; "SQ/SQE—A New Standard in Submersible Pumps;" Brochure; pp. 1-14; Denmark, dated at least as early as Jul. 3, 2013.
Grundfos; "JetPaq—The Complete Pumping System;" Brochure; pp. 1-4; Clovis, CA USA, dated at least as early as Jul. 3, 2013.
Bjarke Soerensen; "Have You Chatted With Your Pump Today?" Article Reprinted with Permission of Grundfos Pump University; pp. 1-2; USA, dated at least as early as Dec. 30, 2014.
Grundfos; "Uncomplicated Electronics . . . Advanced Design;" pp. 1-10; dated at least as early as Dec. 30, 2014.
Amended Complaint Filed by Pentair Water Pool & Spa, Inc. and Danfoss Drives A/S with respect to Civil Action No. 5:11-cv-00459, adding U.S. Pat. No. 8,043,070, filed Jan. 17, 2012.
54DX16—Hayward EcoStar Technical Guide (Version2); pp. 1-51; cited in Civil Action 5:11-cv-004590, copyright 2011.

(56) References Cited

OTHER PUBLICATIONS

54DX19—Stmicroelectronics; "AN1276 BLOC Motor Start Routine for ST72141 Microcontroller;" pp. 1-18; cited in Civil Action 5:11-cv-004590, copyright 2000.
Goulds Pumps "Balanced Flow Systems" Installation Record, dated at least as early as Dec. 14, 2012.
7—Motion for Preliminary Injunction by Danfoss Drives A/S & Pentair Water Pool & Spa, Inc. with respect to Civil Action No. 5:11-cv-00459D, filed Sep. 30, 2011.
540X48—Hopkins; "Partitioning Oigitally . . . Applications to Ballasts;" pp. 1-6; cited in Civil Action 5:11-cv-00459D, Mar. 2002.
45—Plaintiffs' Reply to Defendants' Answer to Complaint & Counterclaim for Civil Action 5:11-cv-00459D, filed Nov. 2, 2011.
50—Amended Answer to Complaint & Counterclaim by Defendants for Civil Action 5:11-cv-00459D, filed Nov. 23, 2011.
54DX32—Hopkins; "High-Temperature, High-Density . . . Embedded Operation;" pp. 1-8; cited in Civil Action 5:11-cv-00459D, Mar. 2006.
Danfoss, VLT 8000 Aqua Operating Instructions, coded MG.80.A2.02 in the footer, 181 pages, dated at least as early as Dec. 30, 2014.
James Shirley, et al., A mechatronics and material handling systems laboratory: experiments and case studies, International Journal of Electrical Engineering Education 48/1, pp. 92-103, dated at least as early as May 22, 2014.

* cited by examiner

SPEED CONTROL

RELATED APPLICATIONS

This application is a continuation of U.S. application Ser. No. 13/906,177, filed on May 30, 2013, which is a continuation of U.S. application Ser. No. 13/280,105, filed on Oct. 24, 2011 that issued as U.S. Pat. No. 8,465,262, which is a continuation of U.S. application Ser. No. 11/608,887, filed on Dec. 11, 2006 that issued as U.S. Pat. No. 8,043,070, which is a continuation-in-part of U.S. application Ser. No. 10/926,513, filed Aug. 26, 2004 that issued as U.S. Pat. No. 7,874,808 and U.S. application Ser. No. 11/286,888, filed Nov. 23, 2005 that issued as U.S. Pat. No. 8,019,479, the entire disclosures of which are hereby incorporated herein by reference as if fully set forth herein.

FIELD OF THE INVENTION

The present invention relates generally to control of a pump, and more particularly to control of a variable speed pumping system for a pool.

BACKGROUND OF THE INVENTION

Conventionally, a pump to be used in a pool is operable at a finite number of predesigned speed settings (e.g., typically high and low settings). Typically these speed settings correspond to the range of pumping demands of the pool at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pool conditions and/or pumping demands.

Conventionally, it is also typical to equip a pumping system for use in a pool with auxiliary devices, such as a heating device, a chemical dispersion device (e.g., a chlorinator or the like), a filter arrangement, and/or an automation device. Often, operation of a particular auxiliary device can require different pump performance characteristics. For example, operation of a heating device may require a specific water flow rate or flow pressure for correct heating of the pool water. It is possible that a conventional pump can be manually adjusted to operate at one of a finite number of predetermined, non-alterable speed settings in response to a water demand from an auxiliary device. However, adjusting the pump to one of the predetermined, non-alterable settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Accordingly, it would be beneficial to provide a pump that could be readily and easily adapted to provide a suitably supply of water at a desired pressure to aquatic applications having a variety of sizes and features. The pump should be capable of pumping water to a plurality of aquatic applications and features, and should be variably adjustable to a number of user defined speeds, quickly and repeatably, over a range of operating speeds to pump the water as needed when conditions change. Further, the pump should be responsive to a change of conditions and/or user input instructions.

SUMMARY OF THE INVENTION

In accordance with one aspect, the present invention provides a pumping system for moving water of a swimming pool. The pumping system includes a water pump for moving water in connection with performance of an operation upon the water, and an infinitely variable speed motor operatively connected to drive the pump. The pumping system further includes a memory configured to store a plurality of retained speed values, means for providing a plurality of retained speed values to the memory, and means for reading a selected one of the plurality of retained speed values from the memory. The pumping system further includes means for operating the motor at the selected one of the plurality of retained speed values.

In accordance with another aspect, the present invention provides a pumping system for moving water of a swimming pool. The pumping system includes a water pump for moving water in connection with performance of an operation upon the water, and an infinitely variable speed motor operatively connected to drive the pump. The pumping system further includes a storage medium for digitally storing a plurality of pre-established motor speed values and means for receiving input from a user to select one of the plurality of pre-established motor speeds. The pumping system further includes means for operating the motor at the selected one of the plurality of pre-established motor speeds once input is received from a user.

In accordance with another aspect, the present invention provides a pumping system for moving water of a swimming pool. The pumping system includes a water pump for moving water in connection with performance of an operation upon the water, and an infinitely variable speed motor operatively connected to drive the pump. The pumping system further includes a storage medium for digitally storing a plurality of retained speed values and means for operating the motor at a selected one of the plurality of retained speed values. The pumping system further includes means for restarting operation of the motor at the previously selected one of the plurality of retained speed values when power supplied to the motor is interrupted during operation of the motor.

In accordance with yet another aspect, a method of controlling a pumping system for moving water of a swimming pool is provided. The pumping system includes a water pump for moving water in connection with performance of an operation upon the water, and an infinitely variable speed motor operatively connected to drive the pump. The method comprises the steps of providing a memory configured to store a plurality of retained speed values, and providing a plurality of retained speed values to the memory. The method also comprises the steps of reading a selected one of the plurality of retained speed values from the memory, and operating the motor at the selected one of the plurality of retained speed values.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
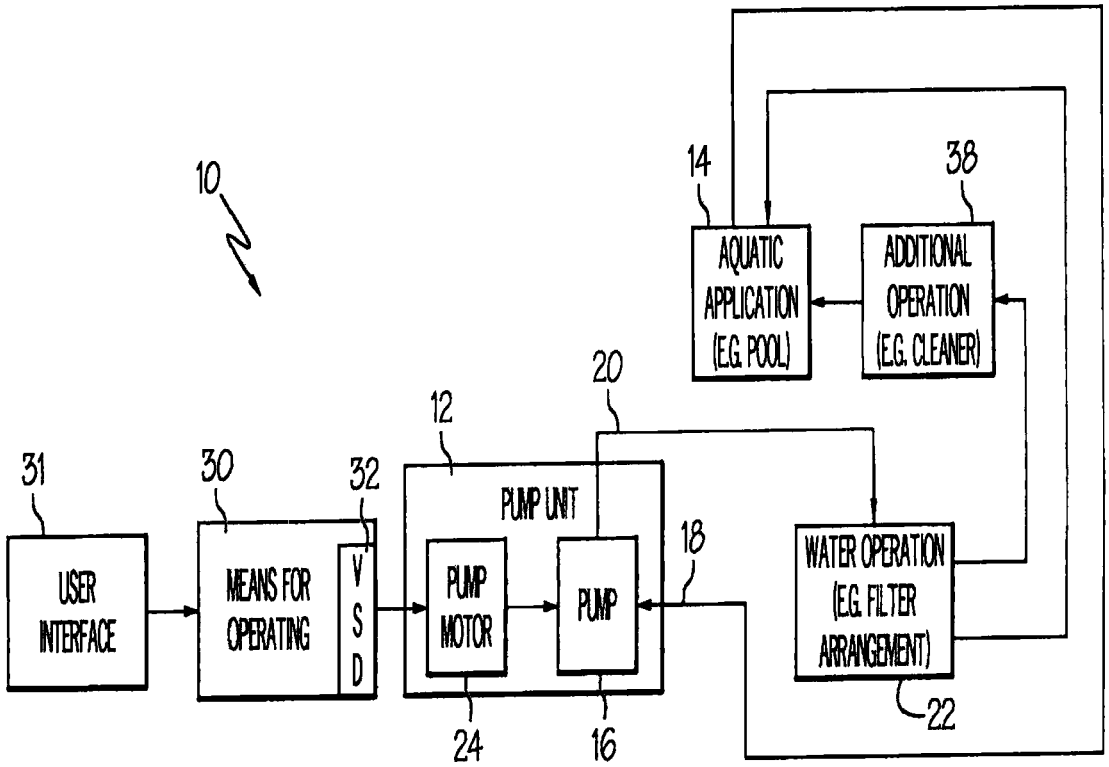
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The swimming pool 14 is one example of a pool. The definition of "swimming pool" includes, but is not limited to, swimming pools, spas, and whirlpool baths, and further includes features and accessories associated therewith, such as water jets, waterfalls, fountains, pool filtration equipment, chemical treatment equipment, pool vacuums, spillways and the like.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., recirculation of the water in a waterfall or spa environment).

Turning to the filter arrangement 22, any suitable construction and configuration of the filter arrangement is possible. For example, the filter arrangement 22 can include a sand filter, a cartridge filter, and/or a diatomaceous earth filter, or the like. In another example, the filter arrangement 22 may include a skimmer assembly for collecting coarse debris from water being withdrawn from the pool, and one or more filter components for straining finer material from the water. In still yet another example, the filter arrangement 22 can be in fluid communication with a pool cleaner, such as a vacuum pool cleaner adapted to vacuum debris from the various submerged surfaces of the pool. The pool cleaner can include various types, such as various manual and/or automatic types.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or asynchronous motor. The pump motor 24 operation is infinitely variable within a range of operation (i.e., zero to maximum operation). In one specific example, the operation is indicated by the RPM of the rotational force provided to rotate the impeller of the pump 16. In the case of a synchronous motor 24, the steady state speed (RPM) of the motor 24 can be referred to as the synchronous speed. Further, in the case of a synchronous motor 24, the steady state speed of the motor 24 can also be determined based upon the operating frequency in hertz (Hz).

A means for operating 30 provides for the control of the pump motor 24 and thus the control of the pump 16. Within the shown example, the means for operating 30 can include a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the means for operating 30 as a whole, and the variable speed drive 32 as a portion of the means for operating 30 are not limitations on the present invention. In one possibility, the pump 16 and the pump motor 24 are disposed within a single housing to form a single unit, and the means for operating 30 with the variable speed drive 32 are disposed within another single housing to form another single unit. In another possibility, these components are disposed within a single housing to form a single unit.

Figure 7:
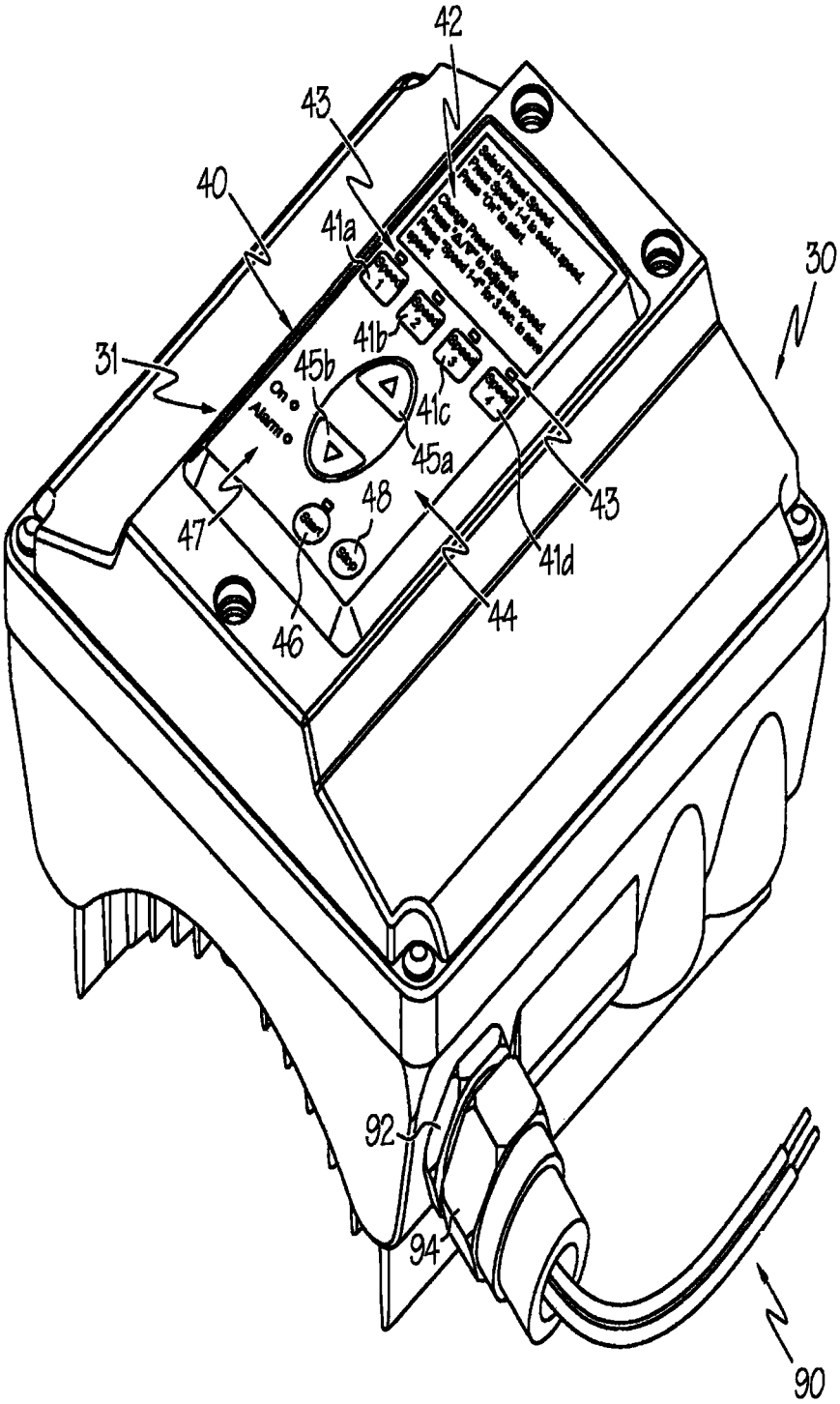
FIG. 7 is a perspective view of an example means for controlling the pump unit shown in FIG. 5.

Further still, the means for operating 30 can receive input from a user interface 31 that can be operatively connected to the means for operating 30 in various manners. For example, the user interface 31 can include means for receiving input 40 from a user, such as a keypad, buttons, switches, or the like such that a user could use to input various parameters into the means for operating 30. As shown in FIG. 7, the means for receiving input 40 can include various buttons having various functions. In one example, the means for receiving input 40 can include a plurality of retained speed buttons 41*a*-41*d*, each button corresponding to the selection of a retained speed value. Each retained speed button 41*a*-41*d* can have an associated visual indicator 43, such as a LED light or the like. Additionally, the user interface 31 can also include various other user input devices, such as a second means for receiving 44 input from a user having buttons 45*a*-45*b* configured to alter a selected speed value. For example, one button 45*a* can be configured to increase a pre-selected speed value, while another button 45*b* can be configured to decrease a pre-selected speed value. Other user input devices can include start 46 and stop 48 buttons configured to start and stop operation of the motor 24. It is to be appreciated that although the shown example of FIG. 7 includes four speed buttons 41*a*-41*d* (e.g., Speed #1-#4), various numbers of speed buttons associated with various numbers of speed values can be used.

In addition or alternatively, the user interface 31 can be adapted to provide visual and/or audible information to a user. In one example, the user interface 31 can include written instructions 42 for operation of the means for operating 30. In another example, the user interface 31 can include one or more visual displays, such as an alphanumeric LCD display (not shown), LED lights 47, or the like. The LED lights 47 can be configured to indicate an operational status, various alarm conditions (e.g., overheat condition, an overcurrent condition, an overvoltage condition, obstruction, or the like) through associated printed indicia, a predetermined number of flashes of various durations or intensities, through color changes, or the like.

Figure 5:
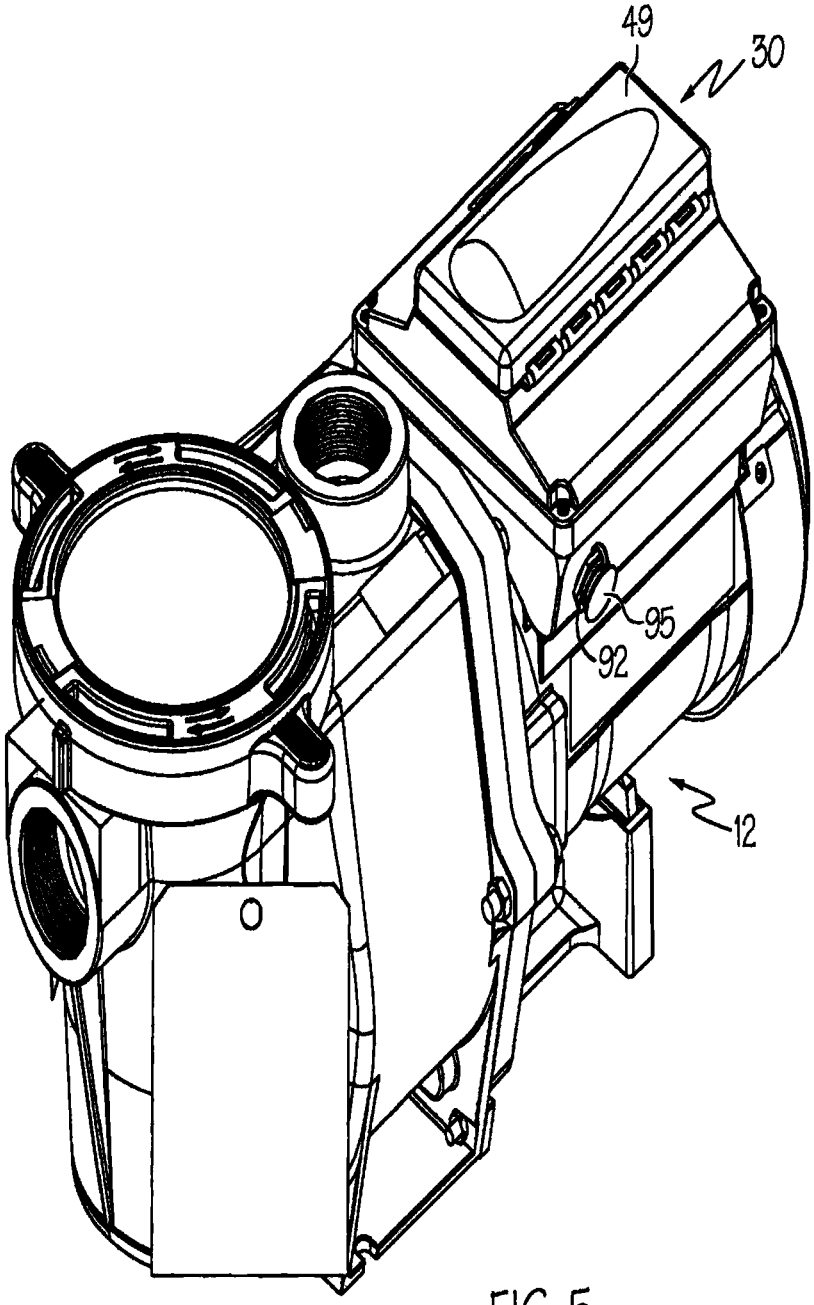
FIG. 5 is a perceptive view of an example pump unit that incorporates the present invention.

Additionally, the user interface 31 can include other features, such as a buzzer, loudspeaker, or the like (not shown) to provide an audible indication for various events. Further still, as shown in FIG. 5, the user interface 31 can include a removable (e.g., pivotable, slidable, detachable, etc.) protective cover 49 adapted to provide protection against damage when the user interface 31 is not in use. The protective cover 49 can include various rigid or semi-rigid materials, such as plastic, and can have various degrees of light permeability, such as opaque, translucent, and/or transparent. For example, where the protective cover 49 is light permeable, a user can view various operational status and/or alarm conditions indicated by the LEDs 47 even when the cover 49 is in a closed position.

The pumping system 10 can have additional means used for control of the operation of the pump. In accordance with one aspect of the present invention, the pumping system 10 includes means for sensing, determining, or the like one or more parameters indicative of the operation performed upon the water. Within one specific example, the system includes means for sensing, determining or the like one or more parameters indicative of the movement of water within the fluid circuit.

The example of FIG. 1 shows an example additional operation 38. Such an additional operation 38 may be a cleaner device, either manual or autonomous. As can be appreciated, an additional operation involves additional water movement. Also, within the presented example, the water movement is through the filter arrangement 22. Such, additional water movement may be used to supplant the need for other water movement, as will be discussed further herein.

The means for controlling 30 can also be configured to protect itself and/or the pump 24 from damage by sensing alert conditions, such as an overheat condition, an overcurrent condition, an overvoltage condition, freeze condition, or even a power outage. The ability to sense, determine or the like one or more parameters may take a variety of forms. For example, one or more sensor or sensor arrangements (not shown) may be utilized. The sensor arrangement of the pumping system 10 can be configured to sense one or more parameters indicative of the operation of the pump 24, or even the operation 38 performed upon the water. Additionally, the sensor arrangement can be used to monitor flow rate and flow pressure to provide an indication of impediment or hindrance via obstruction or condition, whether physical, chemical, or mechanical in nature, that interferes with the flow of water from the pool to the pump such as debris accumulation or the lack of accumulation, within the filter arrangement 34.

Keeping with the example of FIG. 1, some examples of the pumping system 10, and specifically the means for controlling 30 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter is input power. Pressure and/or flow rate can be calculated/determined from such pump parameter(s). Thus, when an alarm condition is recognized, the means for operating 30 can be configured to alert the user (e.g., a visual or audible alert, such as flashing LED 47) and/or reduce the operational speed of the motor 24 until the alarm condition is cleared. In severe cases, the means for operating 30 can even be configured to completely stop operation of the motor (e.g., a lockout condition) until user intervention has cleared the problem.

Within yet another aspect of the present invention, the pumping system 10 may operate to have different constant flow rates during different time periods. Such different time periods may be sub-periods (e.g., specific hours) within an overall time period (e.g., a day) within which a specific number of water turnovers is desired. During some time periods a larger flow rate may be desired, and a lower flow rate may be desired at other time periods. Within the example of a swimming pool with a filter arrangement as part of the water operation, it may be desired to have a larger flow rate during pool-use time (e.g., daylight hours) to provide for increased water turnover and thus increased filtering of the water. Within the same swimming pool example, it may be desired to have a lower flow rate during non-use (e.g., nighttime hours).

Figure 2:
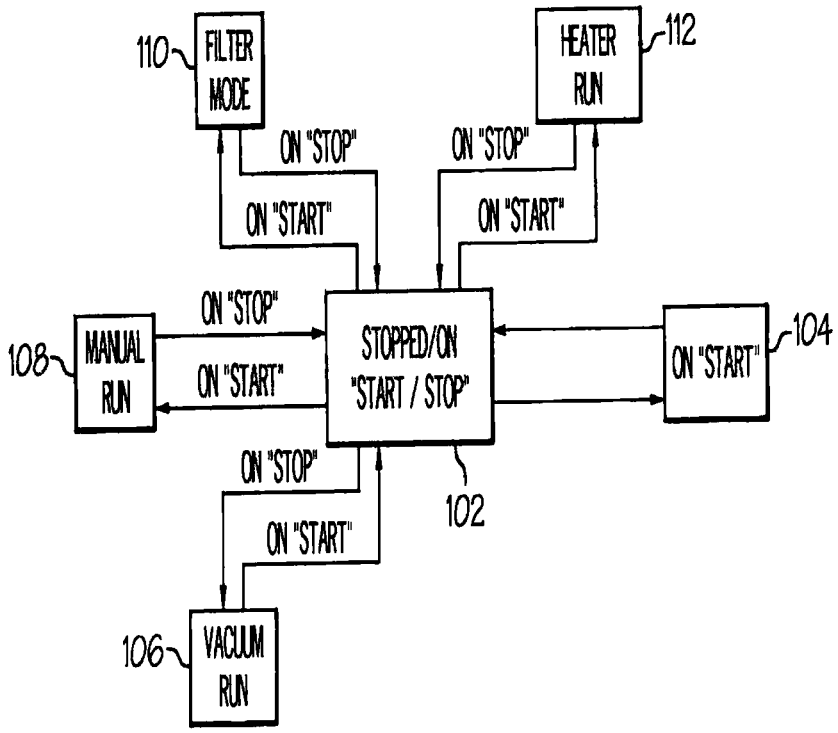
FIG. 2 is function flow chart for an example methodology in accordance with an aspect of the present invention.

Turning to one specific example, attention is directed to the top-level operation chart that is shown in FIG. 2. With the chart, it can be appreciated that the system has an overall ON/OFF status 102 as indicated by the central box. Specifically, overall operation is started 104 and thus the system is ON. However, under the penumbra of a general ON state, a number of water operations can be performed. Within the shown example, the operations are Vacuum run 106, Manual run 108, Filter mode 110, and Cleaning sequence 112.

Briefly, the Vacuum run operation 106 is entered and utilized when a vacuum device is utilized within the pool 14. For example, such a vacuum device is typically connected to the pump 16 possibly through the filter arrangement 22, via a relatively long extent of hose and is moved about the pool 14 to clean the water at various locations and/or the surfaces of the pool at various locations. The vacuum device may be a manually moved device or may autonomously move.

Similarly, the manual run operation 108 is entered and utilized when it is desired to operate the pump outside of the other specified operations. The cleaning sequence operation 112 is for operation performed in the course of a cleaning routine.

Turning to the filter mode 110, this is a typical operation performed in order to maintain water clarity within the pool 14. Moreover, the filter mode 110 is operated to obtain effective filtering of the pool while minimizing energy consumption. Specifically, the pump is operated to move water through the filter arrangement. It is to be appreciated that the various operations 104-112 can be initiated manually by a user, automatically by the means for operating 30, and/or even remotely by the various associated components, such as a heater or vacuum, as will be discussed further herein.

It should be appreciated that maintenance of a constant flow volume despite changes in pumping system 10, such as an increasing impediment caused by filter dirt accumulation, can require an increasing flow rate or flow pressure of water and result in an increasing motive force from the pump/motor. As such, one aspect of the present invention is to provide a means for operating the motor/pump to provide the increased motive force that provides the increased flow rate and/or pressure to maintain the constant water flow.

It is also to be appreciated that operation of the pump motor/pump (e.g., motor speed) has a relationship to the flow rate and/or pressure of the water flow that is utilized to control flow rate and/or flow pressure via control of the pump. Thus, in order to provide an appropriate volumetric flow rate of water for the various operations 104-112, the motor 24 can be operated at various speeds. In one example, to provide an increased flow rate or flow pressure, the motor speed can be increased, and conversely, the motor speed can be decreased to provide a decreased flow rate or flow pressure.

The pumping system 10 can include various elements to facilitate variable control of the pump motor 24, quickly and repeatably, over a range of operating speeds to pump the water as needed when conditions change. In one example, the pumping system 10 can include a storage medium, such as a memory, configured to store a plurality of retained or pre-selected motor speed values. In one example, the storage medium and/or memory can be an analog type, such as tape or other electro-mechanical storage methods. In another example, the storage medium and/or memory can be a digital type, such as volatile or non-volatile random access memory (RAM) and/or read only memory (ROM). The storage medium and/or memory can be integrated into the means for operating 30 the motor, though it can also be external and/or even removable.

Thus, depending upon the particular type of storage medium or memory, the retained or pre-selected speed values can be stored as analog information, such as through a continuous spectrum of information, or can be stored as digital information, such as through discrete units of data, signals, numbers, binary numbers, non-numeric symbols, letters, icons, or the like. Additionally, the retained or pre-selected speed values can be stored either directly as a speed measurement (e.g., RPM) or synchronous frequency (e.g., Hz), or indirectly such as a ranged value (e.g., a value between 1 and 128 or a percentage, such as 50%) or an electrical value (e.g., voltage, current, resistance). It is to be appreciated that the various retained and/or pre-selected motor speed values can be pre-existing, such as factory defaults or presets, or can be user defined values, as will be discussed in greater detail herein. For example, where the retained and/or pre-selected speed values are factory defaults or presets, four speed values can be provided, such as 750 RPM, 1500 RPM, 2350 RPM, and 3110 RPM, though various other speed values can also be used.

Where the various retained and/or pre-selected speed values can be user defined values, the pumping system 10 can also include means for providing a plurality of retained speed values to the storage medium and/or memory. For example, though the factory defaults may provide a sufficient flow rate or flow pressure of water to the swimming pool, a different user defined speed may provide greater efficiency for a user's specific pumping system 10. As can be appreciated, depending upon whether the storage medium or memory is of an analog or digital type, the means for providing can similarly include analog or digital elements for interaction with the storage medium and/or memory. Thus, for example, in an analog system utilizing a tape storage medium, the means for reading can include the associated hardware and electronics for interaction with the tape medium. Similarly, in a digital system, the means for reading can include the various electronics and software for interacting with a digital memory medium.

Additionally, the means for providing can include a user input component configured to receive user defined speed value input from a user, or it can also include a communication component configured to receive the speed value input or parameter from a remote device. In one example, the means for providing retained speed values can include the means for receiving input 40 from a user, such as the previously discussed keypad, buttons, switches, or the like such that a user could use to input various speed values into the means for operating 30.

In one example method of entering a user-defined speed, a user can use the speed alteration buttons **45*a*-45*b* to enter the speed. The user can perform the speed alteration beginning with various values, such as one of the retained speed values associated with speed buttons 41*a*-41*d*, or even a known value, such as the minimum pump speed. For example, a user can use button 45*a* to increase the user entered speed value, or button 45*b* to decrease the speed value to various other speed values between the motor's minimum and maximum speeds (e.g., within an example range of 400 RPM and 3450 RPM). The speed alteration buttons 45*a*-45*b* can be configured to alter the speed in various increments, such as to increase the speed by 1 RPM, 10 RPM, or the like per actuation of the button 45*a*. In one example, the speed alteration buttons 45*a*-45*b* can be quickly actuated and released to increase/decrease the motor speed by 10 RPM. In addition or alternatively, the button 45*a*-45*b* can also be configured to continuously alter the speed value an amount corresponding to the amount of time that the particular button 45*a*-45*b* is actuated (e.g., a touch-and-hold operation), such as to increase/decrease the motor speed by 20 RPM until released. It is to be appreciated that where the user interface 31 includes a numerical, visual display element (e.g., an LCD display or the like, not shown), the current motor speed can be displayed thereon. Alternatively, where the user interface 31 does not include such a numerical visual display, the current motor speed can be indicated by the various LEDs 43, 47 through flashing or color-changing schemes or the like, through an audible announcement or the like, or even on a remotely connected auxiliary device 50**.

It is to be appreciated that the means for operating 30 can be configured to operate the motor 24 at the newly entered user-defined speed immediately upon entry by the user. Thus, the speed can be change "on-the-fly" through actuation of the speed alteration buttons **45*a*-45*b*. Alternatively, the means for operating 30 can wait until the new speed is completely entered before altering operating the motor 24 to operate at the new speed, or could even require the user to press the start button 46 before proceeding to operate at the new speed. In either case, the means for controlling 30 can also be configured to gradually ramp the motor speed towards the new speed to avoid quick speed changes that can cause problems for the pumping system 10, such as water hammer or the like. Further, the motor 24 can continue to operate at the newly entered speed until a different speed is chosen by actuation of one of the speed buttons 41***a*-41*d* or by a remote unit, as will be discussed further herein. Thus, in addition to the four speed values associated with the speed buttons 41*a*-41*d*, the means for controlling 30 can include a fifth user-entered speed value for temporary speed changes.

In addition or alternatively, when a new user-defined speed value has been entered by a user, the means for receiving input 40 can be further configured to provide the new speed value to the storage medium and/or memory for retrieval at a later time (e.g., save the new speed value to memory). In one example, the speed buttons 41*a*-41*d* can be used to store the new speed value to memory through a touch-and-hold operation. Thus, once a user has entered the new desired speed, and wishes to save it in one of the four locations (e.g., Speed #1-#4), the user can actuate the desired button for a predetermined amount of time, such as 5 seconds (e.g., a touch-and-hold operation), though various other amounts of time can also be used. In addition or alternatively, a visual or audible indication can be made to inform the user that the saving operation was successful. Thus, once the new speed is saved and associated with one of the speed buttons 41*a*-41*d*, a user can recall the new speed when desired by briefly actuating that associated speed button 41*a*-41*d*. Accordingly, as used herein, the terms retained speed value and pre-selected speed value can include the factory default or preset speed value, and/or can also include the user entered and saved speed values.

It is to be appreciated that the process of saving a new speed value to one of the four locations (e.g., Speed #1-#4) will replace the existing speed value associated with that button. However, the means for operating 30 can include factory defaults or presets that are stored in a permanent or non-alterable memory, such as ROM. Thus, if desired, it can be possible to reset the speed values associated with the speed buttons 41*a*-41*d* to the factory defaults. In one example, the speed values can be reset by pressing and holding all four speed buttons 41*a*-41*d* for a predetermined amount of time, such as 10 seconds or the like.

The pumping system 10 can further include means for reading a selected one of the retained or pre-selected speed values from the storage medium and/or memory. As can be appreciated, depending upon whether storage medium or memory is of an analog or digital type, the means for reading can similarly include analog or digital elements for interaction with the storage medium and/or memory. Thus, for example, in an analog system utilizing a tape storage medium, the means for reading can include the associated hardware and electronics for interaction with the tape medium. Similarly, in a digital system, the means for reading can include the various electronics and software for interacting with a digital memory medium. In addition to the analog or digital elements configured to actually retrieve the retained or pre-selected speed value from the storage medium and/or memory, the means for reading can also include means for receiving input from a user for choosing which of the plurality of retained or pre-selected speed values are to be retrieved. In one example, the means for providing retained speed values can include the means for receiving input 40 from a user, such as the previously discussed keypad, buttons, switches, or the like such that a user could use to choose a particular speed value.

Thus, in another example method of operation, a user can use the means for receiving input 40 to select one of the plurality of retained speed values. As shown, the four speed buttons 41*a*-41*d* (e.g., Speed #1-#4) can be actuated to select the retained or pre-selected speed value associated therewith. For example, if a user desired to operate the motor 24 at the speed associated with (e.g., saved under) the Speed #2 button 41*b*, the user could briefly actuate the speed button 41*b* to retrieve the saved speed value from memory. Subsequent to the retrieval of the speed value, the means for operating 30 the motor could proceed to alter the speed of the motor 24 towards the retrieved speed value to the exclusion of other speed values.

The pumping system 10 can include additional features, such as means for restarting operation of the motor 24 after a power interruption. For example, where the storage medium and/or memory is of the non-volatile type (e.g., does not require a continuous supply of power to retain the stored data), it can provide an operational reference point after a power interruption. Thus, after the power interruption, the means for restarting can be configured to automatically retrieve the previously selected retained speed value from the storage medium and/or memory, and can also be configured to automatically restart operation of the motor at that speed. As such, even if the power supply to the motor 24 is interrupted, the motor 24 can resume operation in an expeditious manner to so that the pumped water continues to circulate through the swimming pool.

Figure 3:
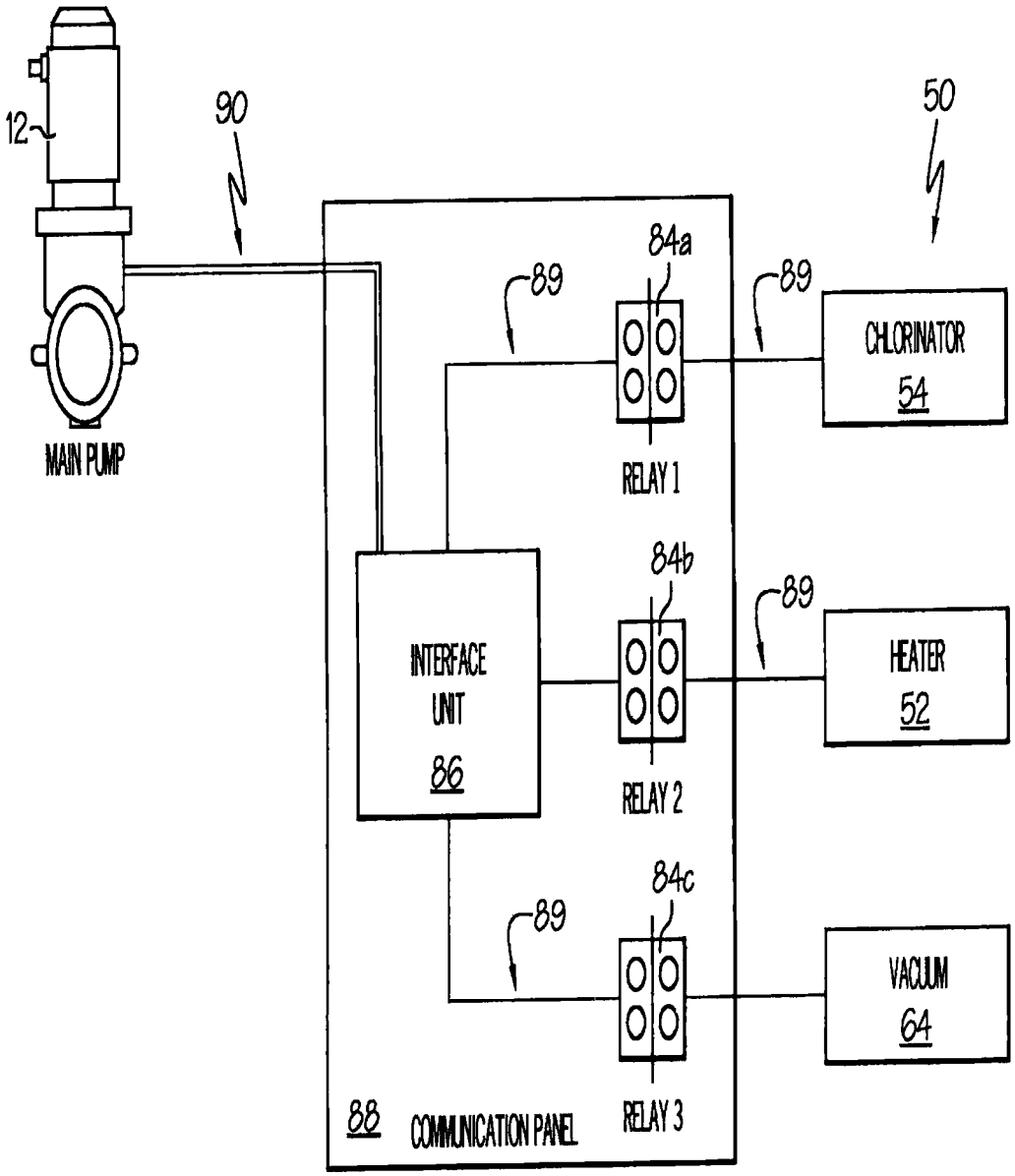
FIG. 3 is a schematic illustration of example auxiliary devices that can be operably connected to the pumping system.
Figure 4:
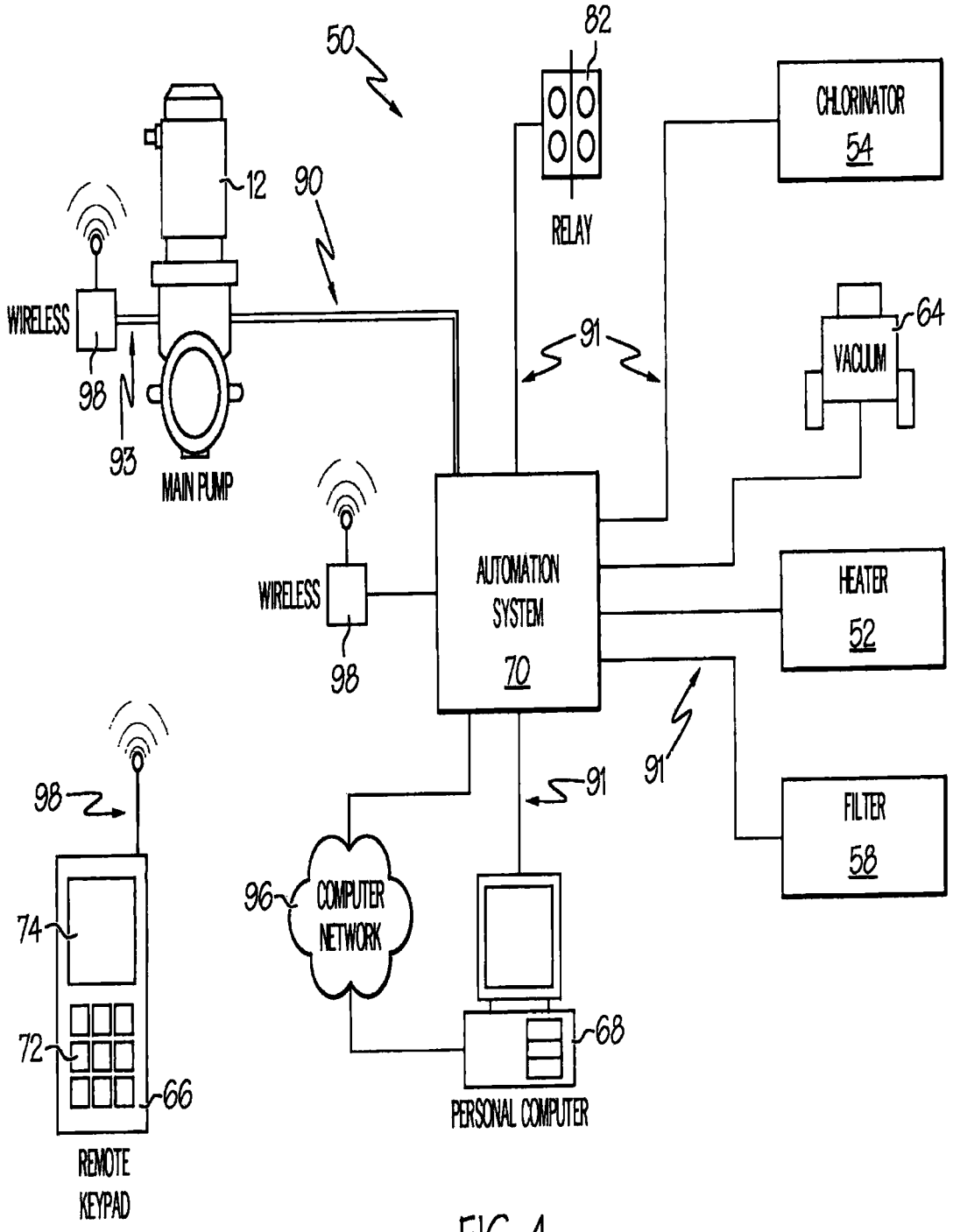
FIG. 4 is similar to FIG. 3, but shows various other example auxiliary devices.

Turning now to FIGS. 3-4, in accordance with other aspects of the present invention, the pumping system 10 can include one or more auxiliary devices 50 operably connected to the means for operating 30. As shown, the auxiliary devices 50 can include various devices, including mechanical, electrical, and/or chemical devices that can be connected to the means for operating 30 in various mechanical and/or electrical manners. In one example, the auxiliary devices 50 can include devices configured to perform an operation upon the water moved by the water pump 12. Various examples can include a water heating device 52, a chemical dispersion device 54 for dispersing chemicals into the water, such as chlorine, bromine, ozone, etc., and/or a water dispersion device (not shown), such as a water fountain or water jet. Further examples can include a filter arrangement 58 for performing a filtering operation upon the water, a second water pump (not shown) with a second pump motor (not shown) for moving the water, and/or a vacuum 64 device, such as a manual or automatic vacuum device for cleaning the swimming pool.

In another example, the auxiliary devices 50 can include a user interface device capable of receiving information input by a user, such as a parameter related to operation of the pumping system 10. Various examples can include a remote keypad 66, such as a remote keypad similar to the keypad of the means for receiving user input 40 and display (not shown) of the means for operating 30, a personal computer 68, such as a desktop computer, a laptop, a personal digital assistant, or the like, and/or an automation control system 70, such as various analog or digital control systems that can include programmable logic controllers (PLC), computer programs, or the like. The various user interface devices 66, 68, 70, as illustrated by the remote keypad 66, can include a keypad 72, buttons, switches, or the like such that a user could input various parameters and information, and can even be adapted to provide visual and/or audible information to a user, and can include one or more visual displays 74, such as an alphanumeric LCD display, LED lights, or the like, and/or a buzzer, loudspeaker, or the like (not shown). Thus, for example, a user could use a remote keypad 66 or automation system 70 to monitor the operational status of the pumping system 10, such as the motor speed.

In still yet another example, the auxiliary devices 50 can include various miscellaneous devices (not shown) for interaction with the swimming pool. Various examples can include a valve, such as a mechanically or electrically operated water valve, an electrical switch, a lighting device for providing illumination to the swimming pool and/or associated devices, an electrical or mechanical relay 82, a sensor, and/or a mechanical or electrical timing device.

In addition or alternatively, as shown in FIG. 3, the auxiliary device 50 can include a communications panel 88, such as a junction box, switchboard, or the like, configured to facilitate communication between the means for operating 30 and various other auxiliary devices 50. The various miscellaneous devices can have direct or indirect interaction with the water of the swimming pool and/or any of the various other devices discussed herein. It is to be appreciated that the various examples discussed herein and shown in the figures are not intended to provide a limitation upon the present invention, and that various other auxiliary devices 50 can be used.

Additionally, the means for operating 30 can be configured to independently select one of the retained or pre-selected speed values from the storage medium and/or memory for operation of the motor 24 based upon input from an auxiliary device(s) 50. That is, although a user can select an operating speed via the user interface 31, the means for controlling 30 can be capable of independently selecting an operating speed from the memory based upon input from an auxiliary device(s) 50. Further still, a user-defined speed can even be input from an auxiliary device 50. However, it is to be appreciated that the user interface 31 can be configured to override the independent speed selection.

In one example, as shown in FIG. 3, the communication panel 88 can include a plurality of relays 84*a*-84*c* connected to a plurality of auxiliary devices 50, such as a heater 52, chlorinator 54, or vacuum 64. The relays 84*a*-84*c* can include various types of relays, such as power supply relays. For example, when power is supplied to an auxiliary device, the associated power supply relay can be configured to provide/output a power signal. The communication panel 88 can also include an interface unit 86 operatively connected to the relays 84*a*-84*c* through cabling 89 to provide a communication interface between the relays 84*a*-84*c* and the means for operating 30 the pump 12. The interface unit 86 can convert/translate the output power signals of the relays 84*a*-84*c* into a communication language/scheme that is compatible with the means for controlling 30. In one example, the interface unit 86 can convert the power signals of the relays 84*a*-84*c* into digital serial communication. In such a case, the interface unit 86 can be connected to the means for controlling 30 by way of an appropriate data cable 90. It is to be appreciated that the various relays 84*a*-84*c* could also be connected directly to the means for controlling 30.

In an example method of operation, the communication panel 88 can be configured such that each relay 84*a*-84*c* corresponds to one of the four retained/pre-selected speeds stored in the storage medium/memory of the means for controlling 30. Thus, activation of various relays 84*a*-84*c* can permit selection of the various retained speed values stored in memory to provide a form of automated control. For example, when power is supplied to the heater 52 for heating the water, the associated power relay 84*b* (e.g., Relay 2) can send a power signal to the interface unit 86. The interface unit 86 can convert/translate the power signal and transmit it to the means for controlling 30 through the data cable 90, and the means for controlling 30 can select the second speed value (e.g., Speed #2) from memory and operate the motor 24 at that speed. Thus, during operation of the heater 52, the pump 12 can provide an appropriate water flow rate or flow pressure. Similarly, once the heater 52 ceases operation, the power relay 84*b* can be de-energized, and the means for controlling 30 can operate the pump 12 a lower flow rate or flow pressure to increase system efficiency. It is to be appreciated that this form of automated control can be similar to that discussed previously herein with relation to the various operations 104-112 of FIG. 2.

Additionally, the various relays 84*a*-84*c* can be setup in a hierarchy such that the means for controlling 30 can be configured to select the speed value of the auxiliary device 50 associated with the highest order relay 84*a*-84*c* that is energized. In one example, the hierarchy could be setup such that Relay #3 84*c* has a higher order than Relay #1 84*a*. Thus, even if Relay #1 84*a* is energized for operation of the chlorinator 54, a subsequent activation of Relay #3 84*c* for operation of the vacuum 64 will cause the means for controlling 30 to select the speed value associated with Relay #3 84*c*. As such, an appropriate water flow rate or flow pressure can be assured during operation of the vacuum 64. Further, once operation of the vacuum 64 is finished, and Relay #3 84*c* is de-energized, the means for controlling 30 can return to the speed selection associated with Relay #1 84*a*. It is to be appreciated that the hierarchy could be setup variously based upon various characteristics, such as run time, flow rate, flow pressure, etc. of the auxiliary devices 50.

Turning now to the example shown in FIG. 4, the pumping system 10 can also provide for two-way communication between the means for operating 30 and the one or more auxiliary devices 50. The two-way communication system can include various communication methods configured to permit signals, information, data, commands, or the like to be input, output, processed, transmitted, received, stored, and/or displayed. It is to be appreciated that the two-way communication system can provide for control of the pumping system 10, or can also be used to provide information for monitoring the operational status of the pumping system 10. Thus, the various auxiliary devices 50 can each request operation at one of the retained/pre-selected speeds stored in memory, and the means for controlling 30 can operate the motor 24 accordingly. It is to be appreciated that, as shown, each auxiliary device 50 can be operably connected to an automation system 70, though the automation system 70 can be replaced by a relatively simpler communication panel or the like similar to that shown in FIG. 3.

The various communication methods can include half-duplex communication (e.g., to provide communication in both directions, but only in one direction at a time and not simultaneously), or conversely, can include full duplex communication to provide simultaneous two-way communication. Further, the two-way communication system can be configured to provide analog communication, such as through a continuous spectrum of information, or it can also be configured to provide digital communication, such as through discrete units of data, such as discrete signals, numbers, binary numbers, non-numeric symbols, letters, icons, or the like.

In various digital communication schemes, two-way communication can be provided through various digital communication methods. In one example, the two-way communication system can be configured to provide digital serial communication to send and receive data one unit at a time in a sequential manner. Various digital serial communication specifications can be used, such as RS-232 and/or RS-485, both of which are known in the art. In addition or alternatively, the digital serial communication can be used in a master/slave configuration, as is know in the art. Various other digital communication methods can also be used, such as parallel communications (e.g., all the data units are sent together), or the like. It is to be appreciated that, despite the particular method used, the two-way communication system can be configured to permit any of the various connected devices to transmit and/or receive information.

The various communication methods can be implemented in various manners, including customized cabling or conventional cabling, including serial or parallel cabling. In addition or alternatively, the communications methods can be implemented through more sophisticated cabling and/or wireless schemes, such as over phone lines, universal serial bus (USB), firewire (IEEE 1394), ethernet (IEEE 802.03), wireless ethernet (IEEE 802.11), bluetooth (IEEE 802.15), WiMax (IEEE 802.16), or the like. The two-way communication system can also include various hardware and/or software converters, translators, or the like configured to provide compatibility between any of the various communication methods.

Further still, the various digital communication methods can employ various protocols including various rules for data representation, signaling, authentication, and error detection to facilitate the transmission and reception of information over the communications method. The communication protocols for digital communication can include various features intended to provide a reliable exchange of data or information over an imperfect communication method. In an example of RS-485 digital serial communication, an example communications protocol can include data separated into categories, such as device address data, preamble data, header data, a data field, and checksum data.

Additionally, the two-way communication system can be configured to provide either, or both, of wired or wireless communication. In the example of RS-485 digital serial communication having a two-wire differential signaling scheme, a data cable 90 can include merely two wires, one carrying an electrically positive data signal and the other carrying an electrically negative data signal, though various other wires can also be included to carry various other digital signals. As shown in FIGS. 5 and 7, the means for operating 30 can include a data port 92 for connection to a data cable connector 94 of the data cable 90. The data cable 90 can include a conventional metal wire cable, though it could also include various other materials, such as a fiber optic cable. The data cable 90 can be shielded to protect from external electrical interferences, and the data cable connector 94 can include various elements to protect against water and corrosion, such as a water resistant, twist lock connector. The data port 92 can even include a protective cover 95 or the like for use when the data cable 90 is disconnected. Further still, the various auxiliary devices 50 can be operably connected to the means for operating 30 directly or indirectly through various data cables 91.

In addition or alternatively, the two-way communication system can be configured to provide analog and/or digital wireless communication between the means for operating 30 and the auxiliary devices 50. For example, the means for operating 30 and/or the auxiliary devices can include a wireless device 98, such as a wireless transmitter, receiver, or transceiver operating on various frequencies, such as radio waves (including cellular phone frequencies), microwaves, or the like. In addition or alternatively, the wireless device 98 can operate on various visible and invisible light frequencies, such as infrared light. As shown in FIG. 4, the wireless device 98 can be built in, or provided as a separate unit connected by way of a data cable 93 or the like.

In yet another example, at least a portion of the two-way communication system can include a computer network 96. The computer network 96 can include various types, such as a local area network (e.g., a network generally covering to a relatively small geographical location, such as a house, business, or collection of buildings), a wide area network (e.g., a network generally covering a relatively wide geographical area and often involving a relatively large array of computers), or even the internet (e.g., a worldwide, public and/or private network of interconnected computer networks, including the world wide web). The computer network 96 can be wired or wireless, as previously discussed herein. The computer network 96 can act as an intermediary between one or more auxiliary devices 50, such as a personal computer 68 or the like, and the means for operating 30. Thus, a user using a personal computer 68 could exchange data and information with the means for operating 30 in a remote fashion as per the boundaries of the network 96. In one example, a user using a personal computer 68 connected to the internet could exchange data and information (e.g., for control and/or monitoring) with the means for operating 30, from home, work, or even another country. In addition or alternatively, a user could exchange data and information for control and/or monitoring over a cellular phone or other personal communication device.

In addition or alternatively, where at least a portion of the two-way communication system includes a computer network 96, various components of the pumping system 10 can be serviced and/or repaired from a remote location. For example, if the pump 12 or means for operating 30 develops a problem, an end user can contact a service provider (e.g., product manufacturer or authorized service center, etc.) that can remotely access the problematic component through the two-way communication system and the computer network 96 (e.g., the internet). Alternatively, the pumping system 10 can be configured to automatically call out to the service provider when a problem is detected. The service provider can exchange data and information with the problematic component, and can service, repair, update, etc. the component without having a dedicated service person physically present in front of the swimming pool. Thus, the service provider can be located at a central location, and can provide service to any connected pumping system 10, even from around the world. In another example, the service provider can constantly monitor the status (e.g., performance, settings, health, etc.) of the pumping system 10, and can provide various services, as required.

Regardless of the methodology used, the means for operating 30 can be capable of receiving a speed request from one or more of the auxiliary devices 50 through the various two-way communication systems discussed herein. In one example, the means for operating 30 can be operable to alter operation of the motor 24 based upon the speed request received from the auxiliary device(s) 50. For example, where a water heater 52 requires a particular water flow rate for proper operation, the means for operating 30 could receive a desired speed request (e.g., Speed #2 or Speed #4) from the water heater 52 through the two-way communication system. In response, the means for operating 30 could alter operation of the motor 24 to provide the requested speed request (e.g., Speed #2). It is to be appreciated that the auxiliary devices 50 can also be configured to transmit a user defined speed value to the means for operating 30 through the communication system.

Additionally, where the means for operating 30 is capable of independent operation, it can also be operable to selectively alter operation of the motor 24 based upon the speed requests received from the auxiliary device(s) 50. Thus, the means for operating 30 can choose whether or not to alter operation of the motor 24 when it receives a speed request from an auxiliary device 50. For example, where the pumping system 10 is performing a particular function, such as a backwash cycle, or is in a lockout state, such as may occur when the system 10 cannot be primed, the means for operating 30 can choose to ignore a speed request from the heater 52. In addition or alternatively, the means for operating 30 could choose to delay and/or reschedule altering operation of the motor 24 until a later time (e.g., after the backwash cycle finishes).

Thus, the means for operating 30 can be configured to control operation of the variable speed motor 24 independently, or in response to user input. However, it is to be appreciated that the means for operating 30 can also be configured to act as a slave device that is controlled by an automation system 70, such as a PLC or the like. It is to be appreciated that the means for operating 30 can be configured to switch between independent control and slave control. For example, the means for operating 30 can be configured to switch between the control schemes based upon whether the data cable 90 is connected (e.g., switching to independent control when the data cable 90 is disconnected).

In one example, the automation system 70 can receive various speed requests from various auxiliary devices 50, and based upon those requests, can directly control the speed operations of the means for operating 30 to alter operation of the motor 24. For example, over a course of a long period of time, it is typical that a predetermined volume of water flow is desired, such as to move a volume of water equal to multiple turnovers within a specified time period (e.g., a day). Thus, the automation system 70 can be configured to optimize a power consumption of the motor 24 based upon the various speed requests received from the auxiliary device(s) 50. It is to be appreciated that this form of automated control can be similar to that discussed previously herein with relation to the various operations 104-112 of FIG. 2.

Focusing on the aspect of minimal energy usage (e.g., optimization of energy consumed over a time period), the system 10 with an associated filter arrangement 22 can be operated continuously (e.g., 24 hours a day, or some other time amount(s)) at an ever-changing minimum level (e.g., minimum speed) to accomplish the desired level of pool cleaning It is possible to achieve a very significant savings in energy usage with such a use of the present invention as compared to the known pump operation at the high speed. In one example, the cost savings would be in the range of 30-40% as compared to a known pump/filter arrangement.

Energy conservation in the present invention is based upon an appreciation that such other water movement may be considered as part of the overall desired water movement, cycles, turnover, filtering, etc. Associated with operation of various functions and auxiliary devices 50 is a certain amount of water movement. As such, water movement associated with such other functions and devices can be utilized as part of the overall water movement to achieve desired values within a specified time frame (e.g., turnovers per day). Thus, control of a first operation (e.g., filtering at Speed #1) in response to performance of a second operation (e.g., running a pool cleaner at Speed #3) can allow for minimization of a purely filtering aspect. This permits increased energy efficiency by avoiding unnecessary pump operation.

It is to be appreciated that the means for controlling 30 may have various forms to accomplish the desired functions. In one example, the means for operating 30 includes a computer processor that operates a program. In the alternative, the program may be considered to be an algorithm. The program may be in the form of macros. Further, the program may be changeable, and the means for operating 30 is thus programmable. It is to be appreciated that the programming for the means for operating 30 may be modified, updated, etc. through the two-way communication system.

Figure 6:
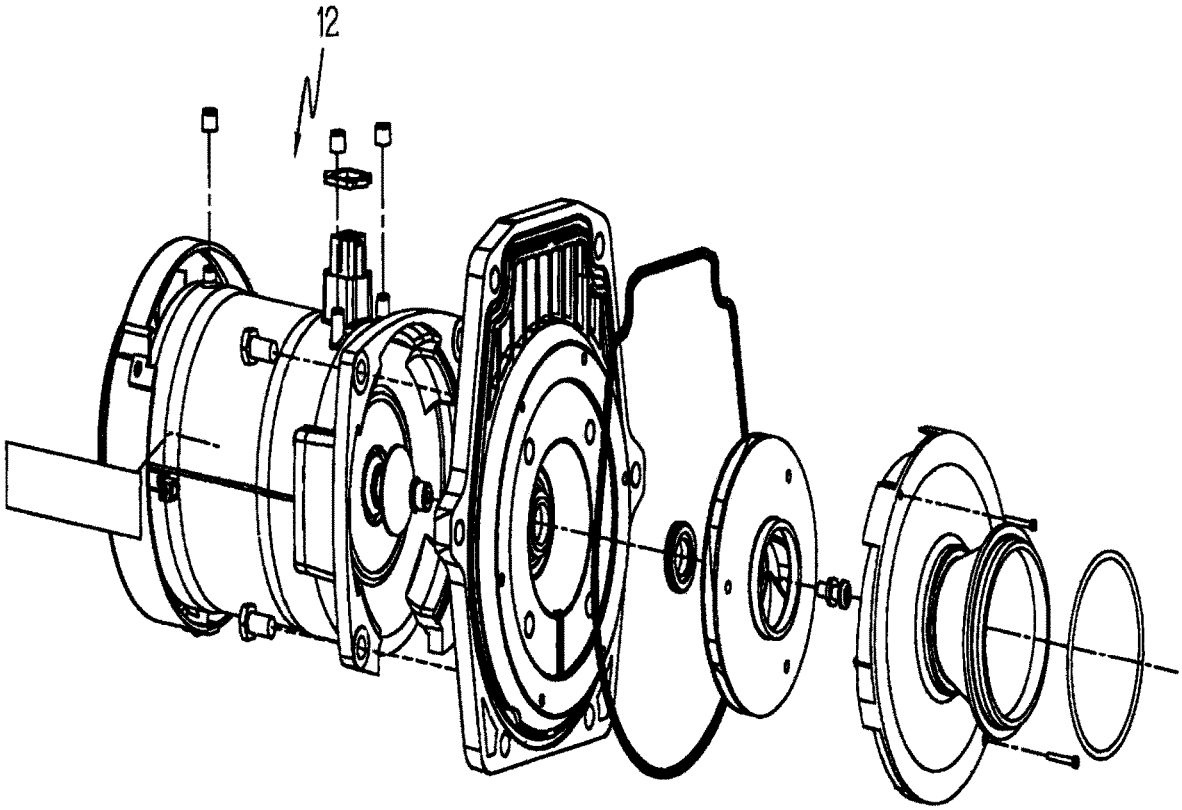
FIG. 6 is a perspective, partially exploded view of a pump of the unit shown in FIG. 5.

Also, it is to be appreciated that the physical appearance of the components of the system 10 may vary. As some examples of the components, attention is directed to FIGS. 5-7. FIG. 5 is a perspective view of the pump unit 12 and the means for operating 30 for the system 10 shown in FIG. 1. FIG. 6 is an exploded perspective view of some of the components of the pump unit 12. FIG. 7 is a perspective view of the means for operating 30.

In addition to the foregoing, a method of controlling the pumping system 10 for moving water of a swimming pool is provided. The pumping system 10 includes a water pump 12 for moving water in connection with performance of an operation upon the water, and an infinitely variable speed motor 24 operatively connected to drive the pump. The method comprises the steps of providing a memory configured to store a plurality of retained speed values, and providing a plurality of retained speed values to the memory. The method also comprises the steps of reading a selected one of the plurality of retained speed values from the memory, and operating the motor at the selected one of the plurality of retained speed values. In addition or alternatively, the method can include any of the various elements and/or operations discussed previously herein, and/or even additional elements and/or operations.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

We claim:

1. A control system for at least one aquatic application, a pump coupled to the at least one aquatic application, the control system comprising:

a variable speed motor adapted to be coupled to the pump;

a memory storing a schedule of speed and timing, a first speed value, and a first time period;

a user interface coupleable to the variable speed motor, the user interface including a first button to select the first speed value and the first time period;

the user interface including a first visual indicator associated with the first button;

the user interface including an increase button and a decrease button to alter at least one of the first speed value and the first time period; and the user interface including a visual display element to display a present speed value; and a controller in communication with the variable speed motor, the memory, and the user interface, the controller operating the variable speed motor according to the schedule, the controller responding to activation of the first button by obtaining the first speed value and the first time period from the memory and initiating operation of the variable speed motor at a constant speed based on the first speed value for the first time period and subsequently operating the variable speed motor according to the schedule after the first time period.

2. The control system of claim 1, wherein the user interface includes:

at least one of a start button to start the variable speed pump and a stop button to stop the variable speed pump; and a removable protective cover.

3. The control system of claim 1, wherein the controller automatically restarts the variable speed motor at the present speed value after a power interruption.

4. The control system of claim 1, wherein the controller communicates with an auxiliary device remote from the pump and the variable speed motor.

5. The control system of claim 4, wherein the auxiliary device includes at least one of a heater, a chemical dispersion device, a water dispersion device, a filter, a second pump, a second motor, and a vacuum.

6. The control system of claim 4, wherein the auxiliary device includes at least one of a remote keypad, a personal computer, a personal digital assistant, a personal communication device, an automation control system, and a communications panel.

7. The control system of claim 4, wherein the auxiliary device includes at least one of a valve, an electrical switch, a lighting device, a sensor, and a timing device.

8. The control system of claim 4, wherein the auxiliary device includes at least one relay that provides a power signal to the controller.

9. The control system of claim 4, wherein the controller is coupled to the auxiliary device by at least one of a wireless communication link, a data cable, a computer network, and a serial communications link.

10. The control system of claim 9, wherein the controller is coupled to the auxiliary device by the data cable, and the data cable is coupled to a data port on the controller.

11. The control system of claim 10, wherein the data port includes a protective cover.

12. The control system of claim 4, wherein the auxiliary device communicates a new speed value to the controller and the controller chooses whether to override the present speed value with the new speed value.

13. The control system of claim 1, wherein the user interface includes at least one light emitting diode to indicate at least one of operational status, an over heat condition, an over current condition, an over voltage condition, an obstruction, a freeze condition, and a power outage.

14. The control system of claim 1, wherein the first speed value is stored in the memory as at least one of revolutions per minute, a synchronous frequency, a value from a range, a percentage, and an electrical value.

15. The control system of claim 1, wherein the first speed value is a factory default and ranges from 600 revolutions per minute to 3450 revolutions per minute.

16. The control system of claim 1, wherein the controller adjusts between the present speed value and the first speed value.

17. The control system of claim 1, and further comprising a communication panel including an interface unit and a heater relay, the heater relay connected to a heater, and wherein when power is supplied to the heater, the heater relay sends a power signal to the interface unit and the interface unit transmits the power signal to the controller in order to automatically select a speed of the variable speed motor that is suitable for operation of the heater.

18. The control system of claim 1, wherein the at least one aquatic application is at least one of a pool and a spa.

19. The control system of claim 1, wherein the user interface is adapted to be mounted remotely from the variable speed motor.

20. The control system of claim 1, the memory storing a second speed value and a second time period, the user interface including a second button to select the second speed value and the second time period, the controller responding to activation of the second button by obtaining the second speed value and the second time period from the memory and operating the variable speed motor at a constant speed based on the second speed value for the second time period and subsequently operating the variable speed motor according to the first speed value and the first time period or the schedule after the second time period.

* * * * *